US010315870B2

(12) United States Patent
Okutsu et al.

(10) Patent No.: US 10,315,870 B2
(45) Date of Patent: Jun. 11, 2019

(54) SHEET FEEDING DEVICE, IMAGE FORMING APPARATUS INCORPORATING THE SHEET FEEDING DEVICE, AND IMAGE FORMING SYSTEM INCORPORATING THE SHEET FEEDING DEVICE

(71) Applicants: Toshihiro Okutsu, Kanagawa (JP); Takashi Fukumoto, Kanagawa (JP); Masaki Ishizaki, Kanagawa (JP); Tatsuya Sugawara, Kanagawa (JP); Sachika Tamaki, Kanagawa (JP); Hideaki Takahashi, Kanagawa (JP); Hidetoshi Kojima, Kanagawa (JP); Yohsuke Takamiya, Kanagawa (JP)

(72) Inventors: Toshihiro Okutsu, Kanagawa (JP); Takashi Fukumoto, Kanagawa (JP); Masaki Ishizaki, Kanagawa (JP); Tatsuya Sugawara, Kanagawa (JP); Sachika Tamaki, Kanagawa (JP); Hideaki Takahashi, Kanagawa (JP); Hidetoshi Kojima, Kanagawa (JP); Yohsuke Takamiya, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/896,417

(22) Filed: Feb. 14, 2018

(65) Prior Publication Data

US 2018/0237239 A1 Aug. 23, 2018

(30) Foreign Application Priority Data

Feb. 21, 2017 (JP) ..... 2017-029639

(51) Int. Cl.
*B65H 3/48* (2006.01)
*B65H 3/12* (2006.01)
(Continued)

(52) U.S. Cl.
CPC ..... *B65H 3/14* (2013.01); *B65H 3/124* (2013.01); *B65H 3/48* (2013.01); *B65H 3/64* (2013.01);
(Continued)

(58) Field of Classification Search
CPC ..... B65H 3/48; B65H 3/124; B65H 3/128; B65H 3/12; B65H 2406/41
See application file for complete search history.

(56) References Cited

U.S. PATENT DOCUMENTS 7,461,839 B2 * 12/2008 Ikeda ..... B65H 3/128 271/108
8,523,171 B2 * 9/2013 Fujita ..... B65H 1/14 271/108
(Continued)

FOREIGN PATENT DOCUMENTS

JP 2011-042470 3/2011
JP 2011-084356 4/2011

*Primary Examiner* — Luis A Gonzalez
(74) *Attorney, Agent, or Firm* — Harness, Dickey & Pierce, P.L.C.

(57) ABSTRACT

A sheet feeding device, which is included in an image forming apparatus and an image forming system, includes a sheet loader, an air drawing body, an attracting and conveying device, an air duct and a blocking device. The sheet loader is a device on which a bundle of sheets is loaded. The air drawing body is configured to generate suction air. The attracting and conveying device is configured to attract a sheet on top of the bundle of sheets by the suction air and convey the sheet. The air duct is configured to intake the suction air drawn by the air drawing body, to the attracting and conveying device. The blocking device is configured to block the suction air in the air duct.

20 Claims, 17 Drawing Sheets

(51) Int. Cl.
*B65H 3/14* (2006.01)
*B65H 3/64* (2006.01)

(52) U.S. Cl.
CPC ..... *B65H 3/128* (2013.01); *B65H 2402/10* (2013.01); *B65H 2405/15* (2013.01); *B65H 2405/332* (2013.01); *B65H 2406/3662* (2013.01); *B65H 2406/41* (2013.01); *B65H 2801/06* (2013.01)

(56) References Cited

U.S. PATENT DOCUMENTS

| | | | | |
|---|---|---|---|---|
| 9,027,919 | B2 * | 5/2015 | Fukusaka | B41J 13/0009 271/111 |
| 9,336,589 | B2 * | 5/2016 | Mochizuki | B65H 1/00 |
| 2008/0297580 | A1 | 12/2008 | Fukumoto et al. | |
| 2009/0014948 | A1 | 1/2009 | Takahashi | |
| 2009/0066008 | A1 | 3/2009 | Hirose et al. | |
| 2012/0313315 | A1 | 12/2012 | Fukumoto et al. | |
| 2013/0087967 | A1 | 4/2013 | Fuda et al. | |
| 2013/0106045 | A1 | 5/2013 | Okutsu et al. | |
| 2014/0131938 | A1 | 5/2014 | Satoh et al. | |
| 2014/0339759 | A1 | 11/2014 | Takahashi et al. | |
| 2016/0107853 | A1 | 4/2016 | Hashimoto et al. | |
| 2016/0107854 | A1 | 4/2016 | Hashimoto et al. | |
| 2016/0122144 | A1 | 5/2016 | Fukumoto et al. | |
| 2017/0081140 | A1 | 3/2017 | Fukumoto et al. | |
| 2017/0327329 | A1 | 11/2017 | Takahashi et al. | |

* cited by examiner

SHEET FEEDING DEVICE, IMAGE FORMING APPARATUS INCORPORATING THE SHEET FEEDING DEVICE, AND IMAGE FORMING SYSTEM INCORPORATING THE SHEET FEEDING DEVICE

CROSS-REFERENCE TO RELATED APPLICATION

This patent application is based on and claims priority pursuant to 35 U.S.C. § 119(a) to Japanese Patent Application No. 2017-029639, filed on Feb. 21, 2017, in the Japan Patent Office, the entire disclosure of which is hereby incorporated by reference herein.

BACKGROUND

Technical Field

This disclosure relates to a sheet feeding device, an image forming apparatus incorporating the sheet feeding device, and an image forming system incorporating the sheet feeding device.

Related Art

Sheet feeding devices included in an image forming apparatus are known to convey an uppermost sheet placed on a sheet bundle loaded on a sheet loading table such as a sheet container, to a sheet attraction belt that functions as an attracting and conveying device.

A known sheet feeding device has the configuration in which an uppermost sheet placed on a sheet bundle loaded on a sheet loading table is attracted to the surface of a sheet attraction belt by suction air applied by an air drawing portion that includes an air drawing fan that functions as an air drawing device, and then is conveyed to an apparatus body of an image forming apparatus. In this known sheet feeding device, after the last sheet on which an image is to be formed is fed, the air drawing fan is stopped to terminate an air drawing operation performed by the air drawing portion. Therefore, detachment of the sheet container is restrained until a predetermined time is completely elapses. This predetermined time is an estimated duration to take the sheet attached to the sheet attraction belt to be peeled off or separated from the sheet attraction belt. Accordingly, after completion of image formation, the sheet container can be detached safely without causing any damage to the sheet by, for example, a sheet peeling claw or claws.

SUMMARY

At least one aspect of this disclosure provides a sheet feeding device including a sheet loader, an air drawing body; an attracting and conveying device, an air duct and a blocking device. The sheet loader is a device on which a bundle of sheets is loaded. The air drawing body is configured to generate suction air. The attracting and conveying device is configured to attract a sheet on top of the bundle of sheets by the suction air and convey the sheet. The air duct is configured to intake the suction air drawn by the air drawing body, to the attracting and conveying device. The blocking device is configured to block the suction air in the air duct.

Further, at least one aspect of this disclosure provides an image forming apparatus including an image forming device configured to form an image on a sheet, and the above-described sheet feeding device configured to feed the sheet toward the image forming device.

Further, at least one aspect of this disclosure provides an image forming system including an image forming apparatus including an image forming device configured to form an image on a sheet, and the above-described sheet feeding device configured to feed the sheet toward the image forming device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
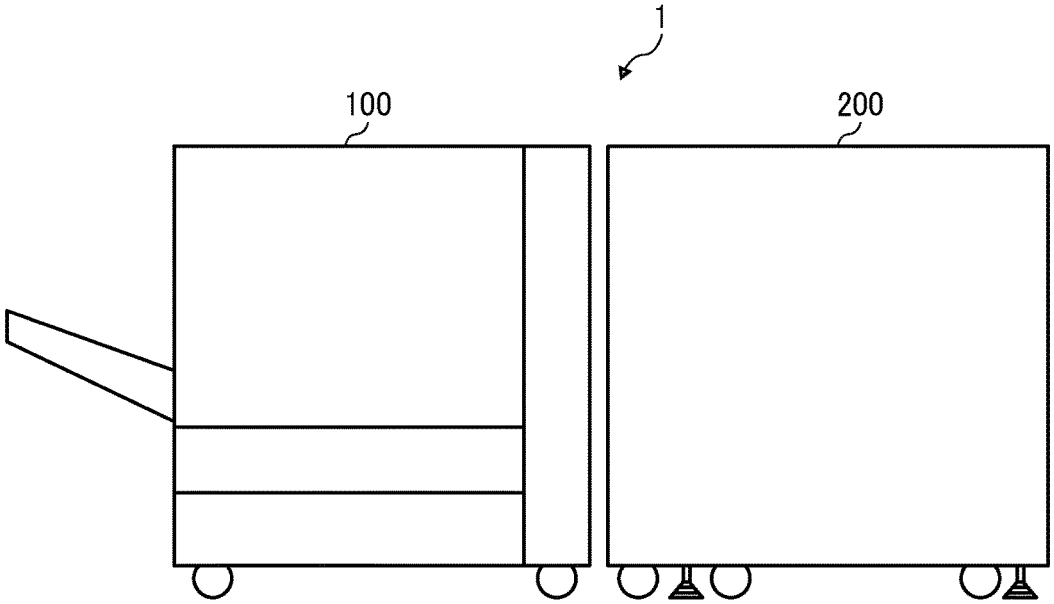
FIG. 1 is a diagram illustrating a schematic configuration of an image forming system according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of a sheet feeding device according to an embodiment of this disclosure.

FIG. 1 is a diagram illustrating a schematic configuration of an image forming system 1 according to an embodiment of this disclosure.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic printer that prints toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 1, the image forming system 1 includes an image forming apparatus 100 and a sheet feeding device 200. The image forming apparatus 100 forms an image on a sheet. The sheet feeding device 200 feeds the sheet to the image forming apparatus 100. The sheet feeding device 200 is disposed on a side face of a housing of the image forming apparatus 100.

A description is given of an entire configuration and functions of the image forming apparatus 100 such as a printer and a copier, according to an embodiment of this disclosure. The image forming apparatus 100 may include a sheet feeding device according to an embodiment of this disclosure.

Figure 2:
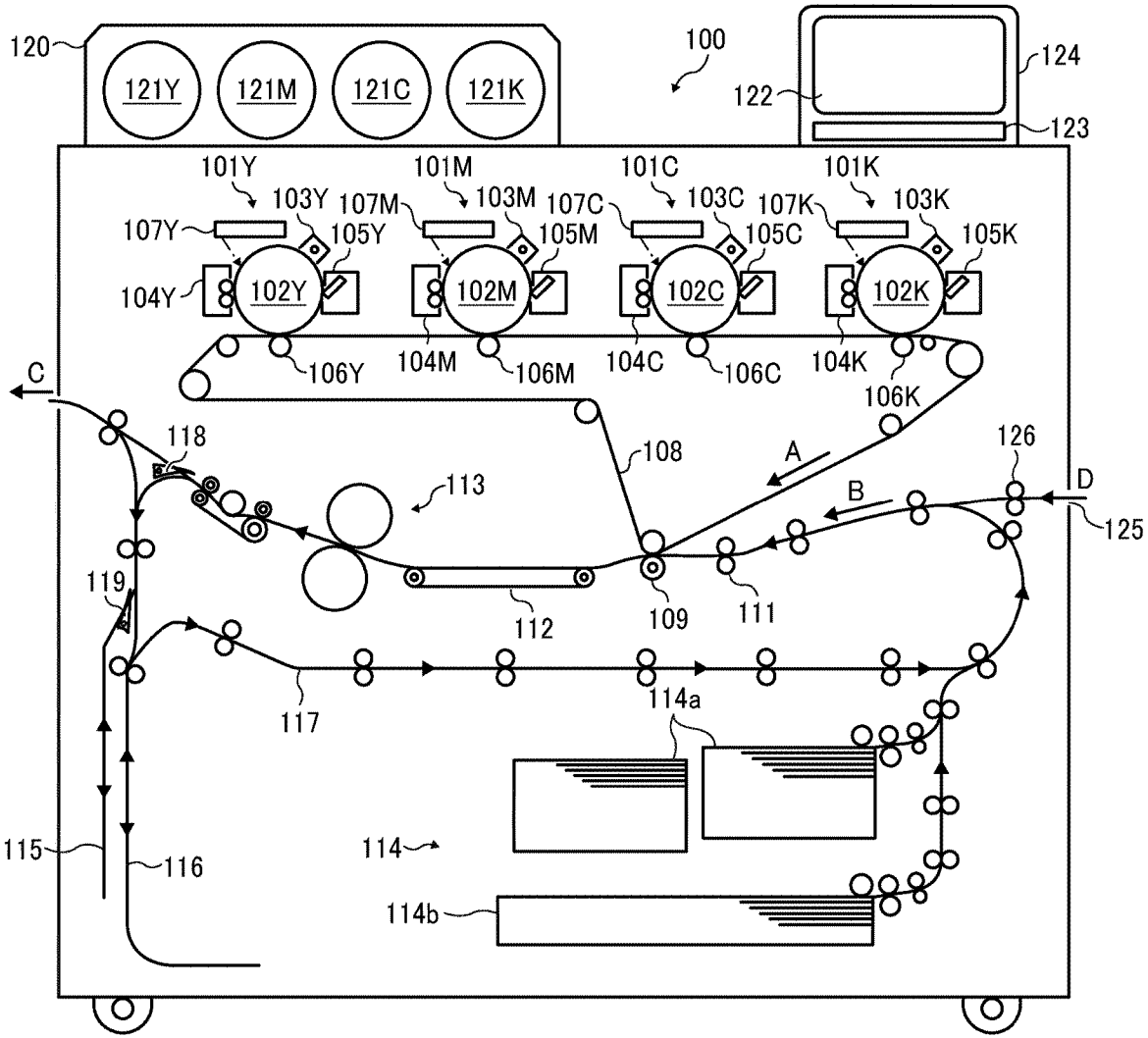
FIG. 2 is a diagram illustrating a schematic configuration of an image forming apparatus according to an embodiment of this disclosure.

FIG. 2 is a schematic diagram illustrating the image forming apparatus 100 according to the present embodiment of this disclosure.

The image forming apparatus 100 has printing and copying functions for forming a full color image with four color toners such as yellow (Y), magenta (M), cyan (C) and black (K). As illustrated in FIG. 2, the image forming apparatus 100 includes four image forming units 101Y, 101M, 101C and 101K. The image forming units 101Y, 101M, 101C and 101K that form respective single color images are aligned at an upper part of the housing of the image forming apparatus 100. The image for units 101Y, 101M, 101C and 101K have a substantially identical configuration and functions to each other. Therefore, following details of the image forming units 101Y, 101M, 101C and 101K are described with a single image forming unit that corresponds to each of the image forming units 101Y, 101M, 101C and 101K, without the suffixes Y, M, C and K indicating respective colors. The image forming unit 101 (i.e., the image forming units 101Y, 101M, 101C and 101K) includes a photoconductor drum 102 (i.e., photoconductor drums 102Y, 102M, 102C and 102K), a charger 103 (i.e., chargers 103Y, 103M, 103C and 103K), a developing device 104 (i.e., developing devices 104Y, 104M, 104C and 104K) and a cleaning device 105 (i.e., cleaning devices 105Y, 105M, 105C and 105K). The charger 103, the developing device 104, and the cleaning device 105 are disposed around the photoconductor drum 102. Further, an optical writing device 107 is disposed above the photoconductor drum 102.

An intermediate transfer belt 108 is disposed below the image forming units 101Y, 101M, 101C and 101K. The intermediate transfer belt 108 is wound around multiple support rollers. As one of the multiple support rollers is driven by a drive unit, the intermediate transfer belt 108 is rotated in a direction indicated by arrow A in FIG. 1. A transfer roller 106 (i.e., transfer rollers 106Y, 106M, 106C and 106K) that functions as a primary transfer unit is disposed facing the photoconductor drum 102 of the image forming unit 101 with the intermediate transfer belt 108 interposed therebetween. When the transfer roller 106 and the photoconductor drum 102 contact with the intermediate transfer belt 108 interposed therebetween, a primary transfer portion is formed to primarily transfer the toner image onto the photoconductor drum 102.

It is to be noted that the image forming unit 101 (i.e., the image forming units 101Y, 101M, 101C and 101K), the transfer roller 106 (i.e., the transfer rollers 106Y, 106M, 106C and 106K) and the intermediate transfer belt 108 function as an image forming device.

In the image forming unit 101, the photoconductor drum 102 is rotated in a counterclockwise direction in FIG. 1. Then, the charger 103 uniformly charges a surface of the photoconductor drum 102 to a predetermined polarity. Then, an optically modulated laser light beam is emitted from the optical writing device 107, so that an electrostatic latent image is formed on the charged surface of the photoconductor drum 102. The electrostatic latent image is developed with toner applied by the developing device 104 into a visible toner image. The visible toner images of respective single colors formed by the image forming units 101Y, 101M, 101C and 101K are sequentially transferred in layers onto a surface of the intermediate transfer belt 108.

By contrast, a sheet feeding section 114 that functions as a sheet feeding device included in the image forming apparatus 100 is disposed in a lower part of the housing of the image forming apparatus 100. The sheet feeding section 114 includes sheet trays 114*a* and 114*b*. A sheet that functions as a recording medium is fed out from one of the sheet feeding section 114 and the sheet feeding device 200 that is attached to the image forming apparatus 100. The fed sheet is conveyed to a pair of registration rollers 111 in a direction indicated by arrow B in FIG. 2.

The sheet contacted and temporarily stopped at the pair of registration rollers 111 is fed out from the pair of registration rollers 111 in synchronization with movement of the toner image formed on the surface of the intermediate transfer belt 108. Then, the sheet is conveyed to a secondary transfer portion where a secondary transfer roller 109 contacts the intermediate transfer belt 108. A voltage having an opposite polarity to a toner charge polarity is applied to the secondary transfer roller 109. By so doing, the composite toner image (the full color image) formed on the surface of the intermediate transfer belt 108 is transferred onto the sheet. After the toner image has been transferred to the sheet, the sheet is conveyed by a sheet conveying belt 112 to a fixing device 113. In the fixing device 113, the toner image is fixed to the sheet by application of heat and pressure. After the toner image is fixed to the sheet, the sheet is ejected out of the housing of the image forming apparatus 100 as indicated by arrow C in FIG. 2 onto a sheet ejection tray.

It is to be noted that, when the sheet is ejected with the back of the sheet facing up in the single-side printing (a face down ejection), the sides (i.e., the front and the back) of the sheet are reversed by ejecting the sheet outside the housing of the image forming apparatus 100 as indicated by arrow C in FIG. 1 via a sheet reverse portion 115. Further, in the duplex printing, the pair of registration rollers 111 after the toner image has been fixed thereto is conveyed via a duplex reverse portion 116 from a reentry passage 117 to the pair of registration rollers 111 again. By so doing, a toner image formed on the surface of the intermediate transfer belt 108 is transferred onto the back of the sheet. After the toner image has been transferred onto the sheet, the toner image is fixed to the sheet in the fixing device 113. Then, similar to the single-side printing, the sheet is ejected out in the direction C in FIG. 1 directly from the fixing device 113 or via the sheet reverse portion 115. In addition, switching claws 118 and 119 are disposed appropriately to switch a sheet conveying direction.

In a case of a monochrome printing, the image forming apparatus 100 according to the present embodiment uses the image forming unit 101K to form a monochrome toner image and transfers the monochrome toner image onto a sheet via the intermediate transfer belt 108. A sheet having a monochrome toner image thereon is handled along the same process as a sheet having a full color toner image after the toner image is fixed to the sheet.

It is to be noted that the image forming apparatus 100 further includes a toner bottle set 120 on an upper face of the housing. The toner bottle set 120 sets respective color toner bottles 121 (i.e., toner bottles 121Y, 121M, 121C and 121K) that contains toner to be supplied to the developing device 104 of the image forming unit 101. Further, the image forming apparatus 100 further includes an operation unit 124 that includes a display 122 and a control panel 123. In addition, a sheet feeding device is provided on the right side of the housing of the image forming apparatus 100 in FIG. 2. A sheet conveyed from the sheet feeding device 200 (FIG. 3) comes in the housing of the image forming apparatus 100 through the sheet entrance D. At the sheet entrance D, a bypass tray opening 125 and a pair of bypass rollers 126 are provided. The sheet is received through the bypass tray opening 125 and then is conveyed by the pair of bypass rollers 126.

Figure 3:
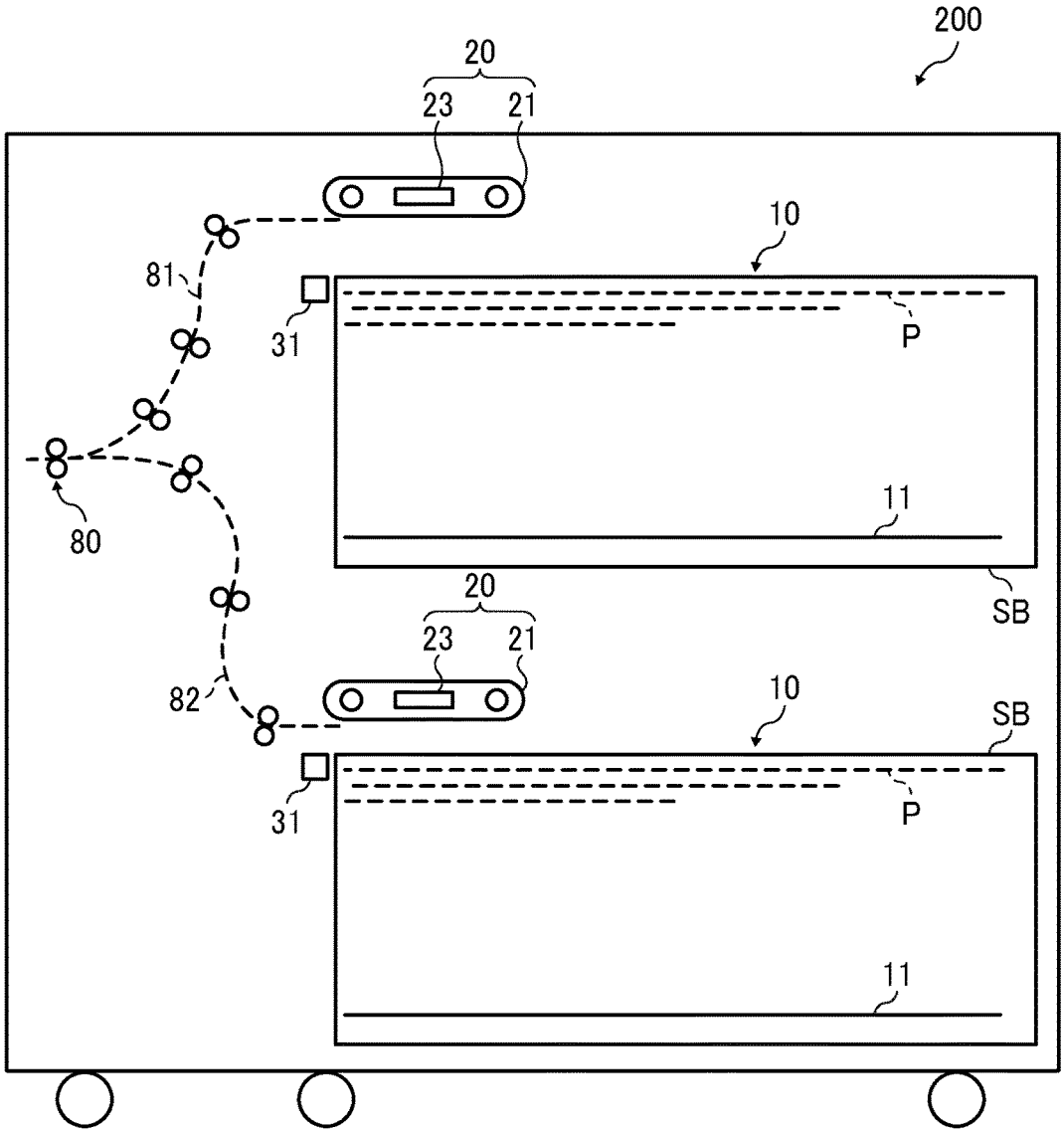
FIG. 3 is a schematic diagram illustrating the sheet feeding device according to an embodiment of this disclosure.

FIG. 3 is a diagram illustrating a schematic configuration of the sheet feeding device 200 according to the present embodiment of this disclosure. The sheet feeding device 200 is disposed on the side face of the housing of the image forming apparatus 100.

The sheet feeding device 200 includes two sheet trays 10 disposed vertically to each other (i.e., a lower sheet tray 10 and an upper sheet tray 10). Each of the sheet trays 10 includes a sheet loading table 11 that functions as a sheet loader on which a sheet bundle SB is loaded. In the present embodiment, each of the sheet trays 10 can contain up to about 2500 sheets therein. It is to be noted that the term "sheet" includes plain paper, coated paper, label paper, OHP sheet and film, and the like. A sheet feeding unit 20 is disposed above the corresponding sheet tray 10. The sheet feeding unit 20 separates and feeds a sheet loaded on the sheet tray 10. The sheet feeding unit 20 includes a sheet attraction belt 21 and an air drawing device 23, both functioning as an attracting and conveying device.

Each sheet loaded on the lower sheet tray 10 passes through a lower conveying passage 82 to be conveyed by a pair of outlet rollers 80 to the housing of the image forming apparatus 100. Similarly, each sheet loaded on the upper sheet tray 10 passes through an upper conveying passage 81 to be conveyed by the pair of outlet rollers 80 to the housing of the image forming apparatus 100.

Further, each of the sheet trays 10 further includes a sheet face detection sensor 31 to detect a floating sheet that is lifted by an air blowing device to control vertical movement of the sheet loading table 11.

Figure 4:
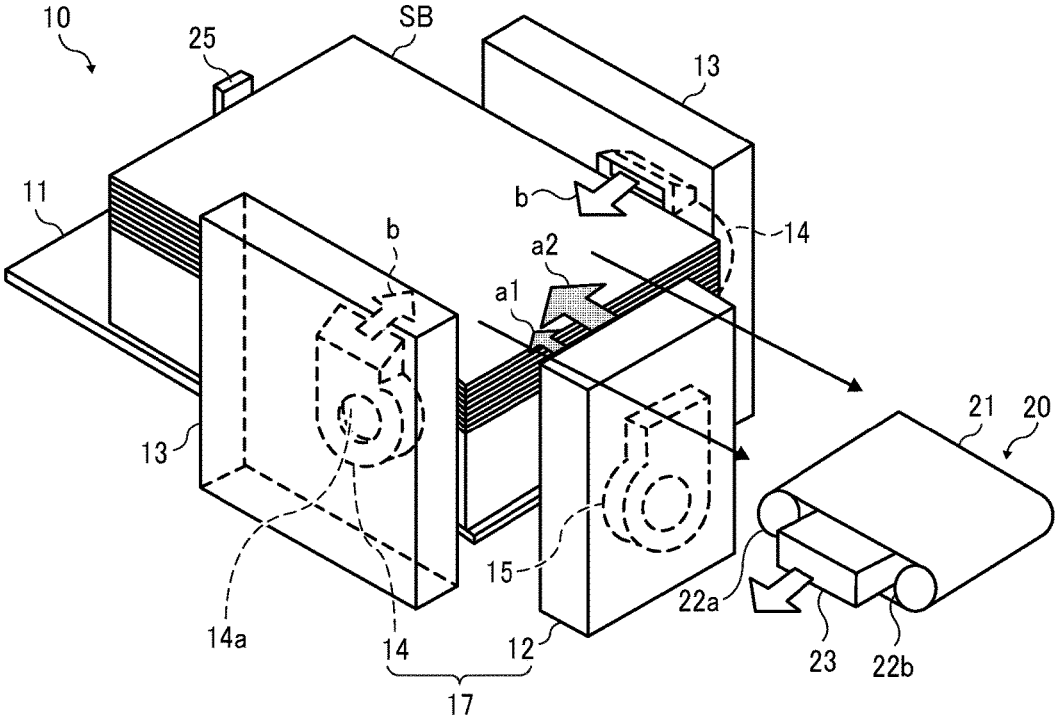
FIG. 4 is a perspective vie rating a sheet tray included in the sheet feeding device.

FIG. 4 is a perspective view illustrating one of the sheet trays 10 included in the sheet feeding device 200.

The sheet attraction belt 21 of the sheet feeding unit 20 is stretched by two tension rollers 22*a* and 22*b* and includes multiple air drawing openings over an entire region in a circumferential direction thereof. The multiple air drawing openings penetrate through the sheet attraction belt 21 from a front face side to a back face side thereof. An air drawing device 23 is disposed within an inner loop of the sheet attraction belt 21. The air drawing device 23 is coupled with an air drawing fan 61 that functions as an air drawing body to intake air via an air duct 41 that functions as an air flowing passage. As the air drawing device 23 generates a negative pressure in a lower area, a sheet P is attracted to a lower face of the sheet attraction belt 21. A detailed description of the air drawing device 23 is described below.

Further, each sheet tray 10 includes an air blowing device 17 that functions as an air blower to blow air to the upper sheets of the sheet bundle SB. The air blowing device 17 includes a front air blowing device 12 and a side air blowing device 14.

The front air blowing device 12 is disposed at a downstream side end in the sheet conveying direction and a side plate is disposed facing the leading end of the sheet P of the sheet bundle SB. As the sheet bundle SB contacts or abuts the side plate of the front air blowing device 12, the side plate of the front air blowing device 12 regulates a leading end position of the sheet bundle SB in the sheet conveying direction. The front air blowing device 12 that functions as a floating air blower and a separating air blower and blows air to the leading end of the upper part of the sheet bundle SB (i.e., a downstream side end in the sheet conveying direction). The front air blowing device 12 includes a floating nozzle, a separation nozzle, and two air blowing fans 15. The floating nozzle guides air in a direction to float the sheet bundle SB. The separation nozzle guides air in a direction to separate an uppermost floating sheet and other floating sheet(s). The two air blowing fans 15 (hereinafter, simply referred to as an air blowing fan 15) blow air to the floating nozzle and the separation nozzle. Air that is blown from the floating nozzle in a direction indicated by arrow a1 in FIG. 4 is referred to as floating air. Air that is blown from the separation nozzle in a direction indicated by arrow a2 in FIG. 4 is referred to as separation air. The floating air and the separation air are discharged from respective portions facing the leading end of the upper sheets of the sheet bundle SB (i.e., the downstream side end in the sheet conveying direction). Consequently, the floating air and the separation air are blown to the leading end of the upper sheets of the sheet bundle SB (i.e., the downstream side end in the sheet conveying direction).

The side air blowing device 14 is mounted on both sides of a pair of side fences 13 to blow air in a direction indicated by arrow b in FIG. 4, to the side face of the upper sheets of the sheet bundle SB. The side air blowing device 14 includes a side floating nozzle that flips and separates the sheets P in bundle and guides air to a direction to lift the sheets P. Air that is blown from the side floating nozzle in the direction indicated by arrow b in FIG. 4 is referred to as side air. The side air is discharged from an air discharging port that is provided at a portion of each of the pair of side fences 13, facing the upper side of the sheet bundle SB. Consequently, the floating air is discharged from the air discharging port and is blown to the side face of the upper side of the sheet bundle SB. Due to the front air blowing device 12 and the air discharged and blown through the air discharging ports of the pair of side fences 13, the upper sheet of the sheet bundle SB is lifted to float.

Further, each sheet tray 10 includes an end fence 25 to align the trailing end of the sheet bundle SB loaded on the sheet loading table 11.

Next, a detailed description of the air drawing device 23 is described.

Figure 5:
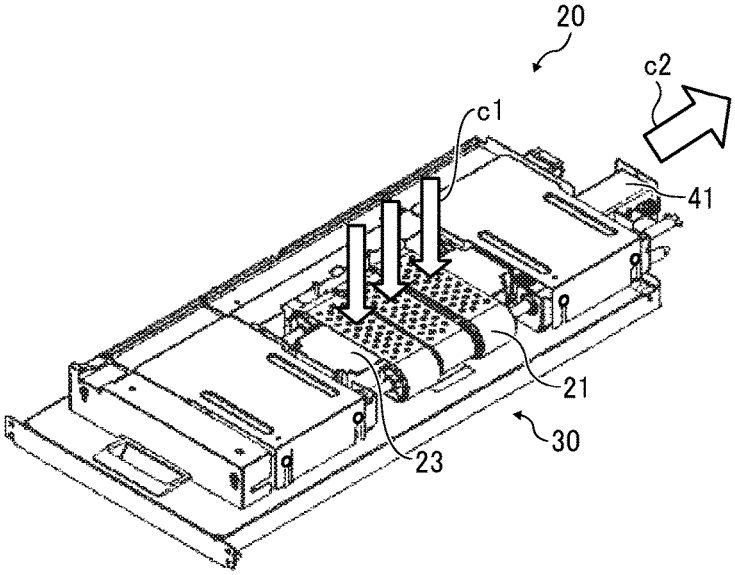
FIG. 5 is a diagram illustrating a sheet feeding unit included in the sheet feeding device, viewed from a rear side of the sheet feeding unit.

FIG. 5 is a diagram illustrating the sheet feeding unit 20 included in the sheet feeding device 200, viewed from a rear side of the sheet feeding unit 20.

As illustrated in FIG. 5, the air drawing device 23 is disposed in an inner loop of the sheet attraction belt 21. A sheet attracting unit 30 in which the attracting and conveying device (i.e., the sheet attraction belt 21) attracts the uppermost sheet and the air drawing fan 61 are connected via the air duct 41. Suction air that is drawn by the sheet drawing fan drawing fan flows in a direction indicated by arrow c1 and a direction indicated by arrow c2 in FIG. 4.

Figure 6A:
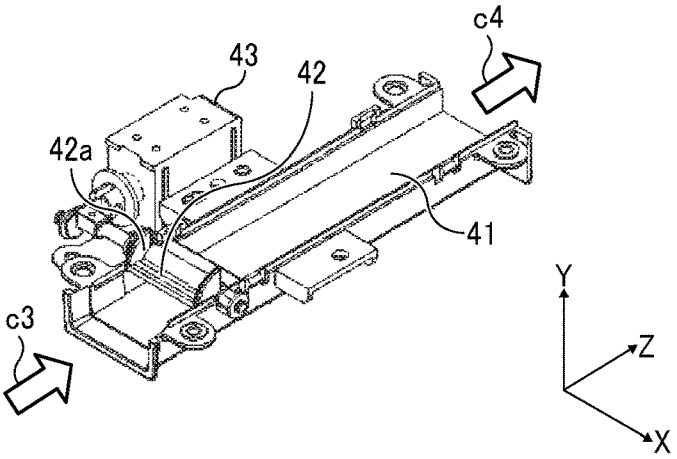
FIGS. 6A, 6B and 6C are schematic diagrams illustrating an air drawing device included in the sheet feeding unit in a state in which a shutter valve of the air drawing device is open.
Figure 6B:
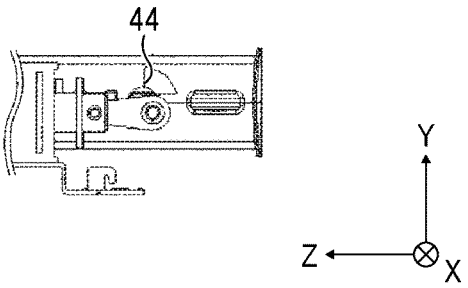
Figure 6C:
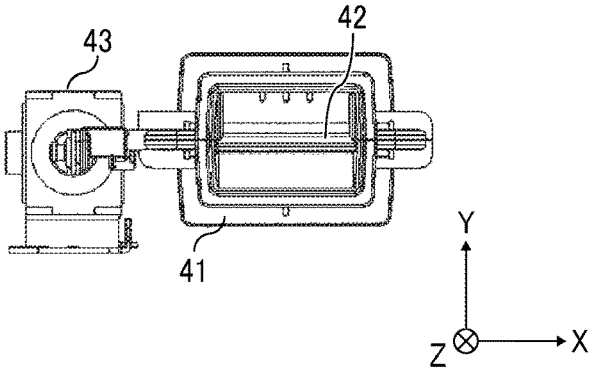

FIGS. 6A, 6B and 6C are schematic diagrams illustrating the air drawing device 23 in a state in which a shutter valve 42 of the air drawing device 23 is open. FIG. 6A is a perspective view illustrating an inside of the air duct 41. FIG. 6B is a side view illustrating the air duct 41 viewed in an x-axis direction. FIG. 6C is a side view illustrating the air duct 41 viewed in a z-axis direction.

Figure 7A:
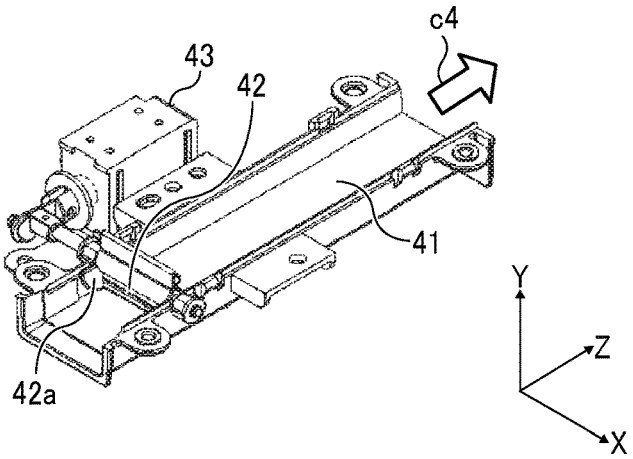
FIGS. 7A, 7B and 7C are schematic diagrams illustrating the air drawing device in a state in which the shutter valve of the air drawing device is closed.
Figure 7B:
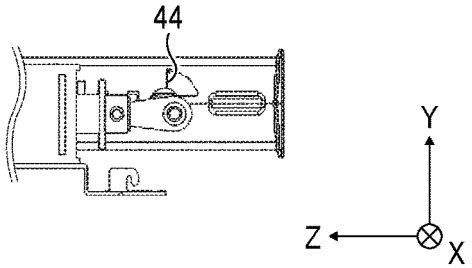
Figure 7C:
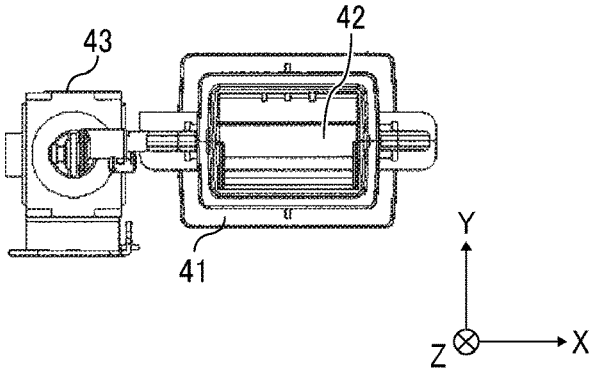

FIGS. 7A, 7B and 7C are schematic diagrams illustrating the air drawing device 23 in a state in which a shutter valve 42 of the air drawing device 23 is closed. FIG. 7A is a perspective view illustrating an inside of the air duct 41. FIG. 7B is a side view illustrating the air duct 41 viewed in an x-axis direction. FIG. 7C is a side view illustrating the air duct 41 viewed in a z-axis direction.

As illustrated in FIG. 6A, in the air drawing device 23 in the present embodiment, the shutter valve 42 that functions as a blocking unit to Hock air passage in the air duct 41.

The shutter valve 42 is coupled to a solenoid via a tension spring. A controller 60 controls ON and OFF of the solenoid to switch shut down and passage of suction air in the air duct 41.

To be more specific, when the solenoid is in a non-energized state in which an air drawing force of the solenoid is not acting, that is, in an OFF state, the shutter valve 42 is pulled by a spring. Therefore, the shutter valve 42 is disposed parallel to an air drawing direction, which is in an open state. By driving the air drawing fan in this state, suction air flows from the sheet attracting unit 30 in a direction indicated by arrow c3 and a direction indicated by arrow c4 in FIG. 7A. By contrast, when the solenoid is completely drawn, that is, in an ON state, the flow of the suction air drawn by the air drawing fan is shut down in the air duct 41, which is a closed state. By driving the air drawing fan in this state, the suction air flowing the direction indicated by arrow c4 is shut down by the shutter valve 42.

As illustrated in FIG. 6B, a leak hole 44 is provided on the side wall of the air duct 41, so as to penetrate or go through the inside of the air duct 41 to connect with the outside of the air duct 41. Shielding portions 42*a*, each of which functioning as a shielding body, are provided at both ends in a width direction of the shutter valve 42, so as to block the leak hole 44 provided to the air duct 41. When the shutter valve 42 is open, the leak hole 44 is blocked by the shielding portions 42*a*. By contrast, when the shutter valve 42 is dosed, the position of the shielding portions 42*a* move along with rotation of the shutter valve 42. According to this movement, the leak hole 44 opens to reduce the static pressure of air suction of the sheet attracting unit 30.

Next, a description is given of a control of a sheet feeding operation according to the present embodiment of this disclosure.

Figure 8:
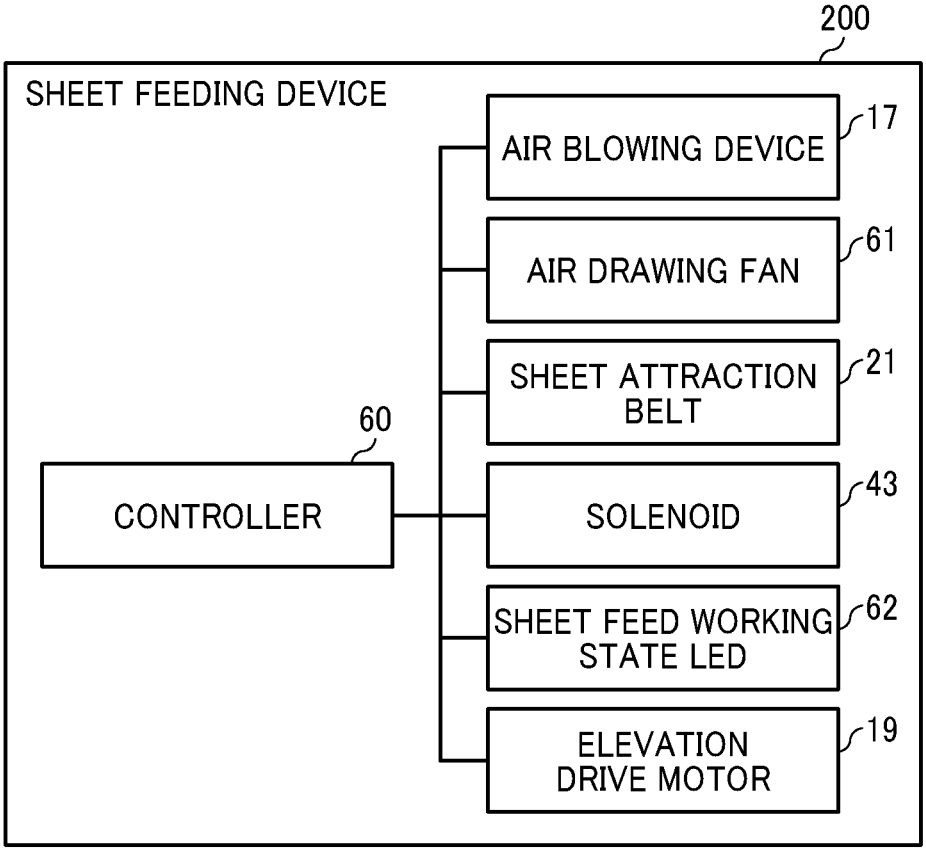
FIG. 8 is a block diagram illustrating a configuration of a control system included in the sheet feeding device according to an embodiment of this disclosure.

FIG. 8 is a block diagram illustrating an example of a configuration of a control system of the sheet feeding device 200 according to an embodiment of this disclosure.

As illustrated in FIG. 8, the controller 60 that functions as a controller of the sheet feeding device 200 includes the air blowing device 17 to blow air toward the front air blowing device 12 and the side air blowing device 14, the air drawing fan 61 coupled with the air drawing device 23, the sheet attraction belt 21, and a solenoid 43 to causes the shutter valve 42 to start working. The controller 60 is further connected to a sheet feed working state LED (light emitting diode) 62 that functions as a working state indicator to display the working state of the sheet feeding device 200, and an elevation drive motor 19 that functions as a loader elevation device to lift and lower the sheet loading table 11.

Next, a description is given of operations when the attracting and conveying device (such as the sheet attraction belt 21 and an air drawing device 23) conveys sheets one by one.

Figure 9:
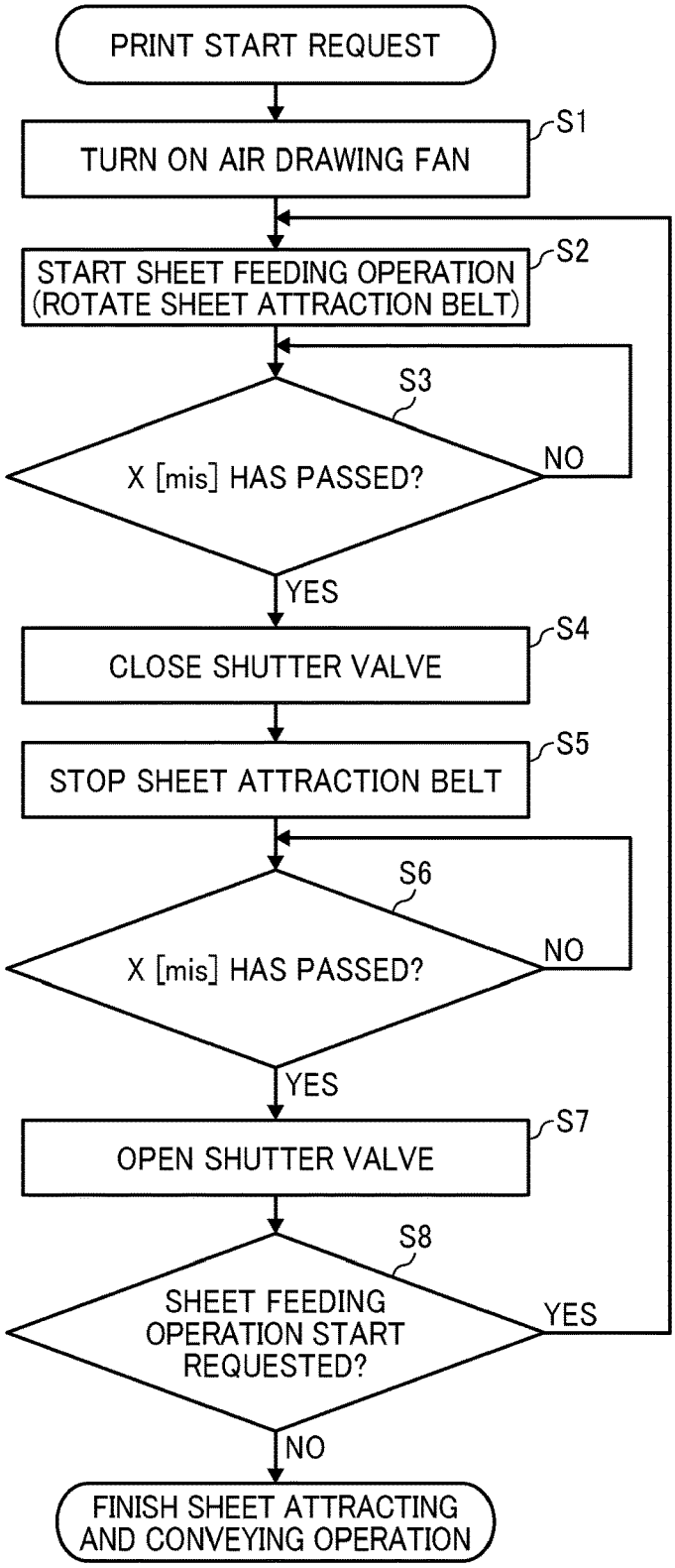
FIG. 9 is a flowchart of an example of sheet conveying operations.

FIG. 9 is a flowchart of an example of sheet conveying operations.

A general controller of the image forming apparatus 100 receives an image forming instruction associated with the sheets set in the sheet trays 10 of the sheet feeding device 200 via a control panel of the image forming apparatus 100. (Hereinafter, "the sheet trays 10" is also be referred to simply as "the sheet tray 10.") Then, the general controller transmits a sheet feeding instruction to the controller 60 of the sheet feeding device 200 and information of types of sheet loaded on the sheet loading table 11 of the sheet trays 10. On receipt of the sheet feeding instruction, the controller 60 starts driving the air blowing device 17 while movement of the sheet attraction belt 21 is being stopped. Accordingly, as illustrated in FIG. 4, air is discharged from the air discharging port of the front air blowing device 12 in a direction indicted by arrow al. Therefore, the air is blown to a front end part of the upper part of the sheet bundle SB. Further, air is discharged from the air discharging port of the pair of side fences 13 to be blown to the side end of the upper side of the sheet bundle SB. Due to the air discharged and blown through the air discharging ports of the front air blowing device 12 and through the air discharging ports of the pair of side fences 13, the upper sheet of the sheet bundle SB is lifted to float.

At the same time, the controller 60 starts driving the air drawing fan 61 to start air drawing by the air drawing device 23 (step S1). As the air drawing device 23 starts air drawing, the air drawing device 23 generates a negative pressure in the lower area, and a floating uppermost sheet P1 is attracted to the sheet attraction belt 21. Then, as the sheet attraction belt 21 rotates, the sheet feeding operation starts (step S2).

Then, the controller 60 determines whether or not the predetermined time has passed from the start of the sheet feeding operation (step S3). When step S3 is NO and the predetermined time has not yet passed, the process repeats step S3. When step S3 is YES and the predetermined time has passed, the shutter valve 42 is closed (step S4), and rotation of the sheet attraction belt 21 is stopped (step S5)

By stopping the sheet attraction belt 21 after a predetermined time has elapsed from the start of the sheet feeding operation, when the trailing end of the uppermost sheet P1 passes an attraction opening, a subsequent sheet on the sheet bundle SB loaded on the sheet tray 10 is prevented from being attracted by the sheet attraction belt 21 and from being conveyed at an unintended timing.

Further, by closing the shutter valve 42 after the predetermined time has passed from the start of the sheet feeding operation, attraction of the sheet attraction belt 21 to the sheet is stopped. Accordingly, the sheet attraction belt 21 is prevented from damages or scratches caused during the sheet conveying operation due to contact of the sheet that has been attracted to the sheet attraction belt 21 with the sheet attraction belt 21 stopped when conveyed by the attracting and conveying device.

Then, the controller 60 determines whether or not a predetermined time has passed from the stop of the sheet attraction belt 21 (step S6). When step S6 is NO and the predetermined time has not yet passed, the process repeats step S6. When step S6 is YES and the predetermined time has passed, the shutter valve 42 is opened to convey a subsequent sheet (step S7), and determines whether or not the start of the sheet feeding operation is requested (step S8). As described above, by opening the shutter valve 42 whether there is a request of the start of the sheet conveying operation or not, the sheet attracting and conveying operation can be performed whenever the start of the sheet feeding operation is requested, and therefore a high productivity can be obtained.

When step S8 is YES and the start of the sheet feeding operation is requested, step S2 through step S7 are repeated to convey the subsequent sheet. When step S8 is NO and the start of the sheet feeding operation is not requested, the sheet attracting and conveying operation is finished, then the controller 60 executes another operation flow after the sheet attracting and conveying operation.

Next, a description is given of the operations after completion of the sheet attracting and conveying operation, according to the present embodiment of this disclosure.

Figure 10:
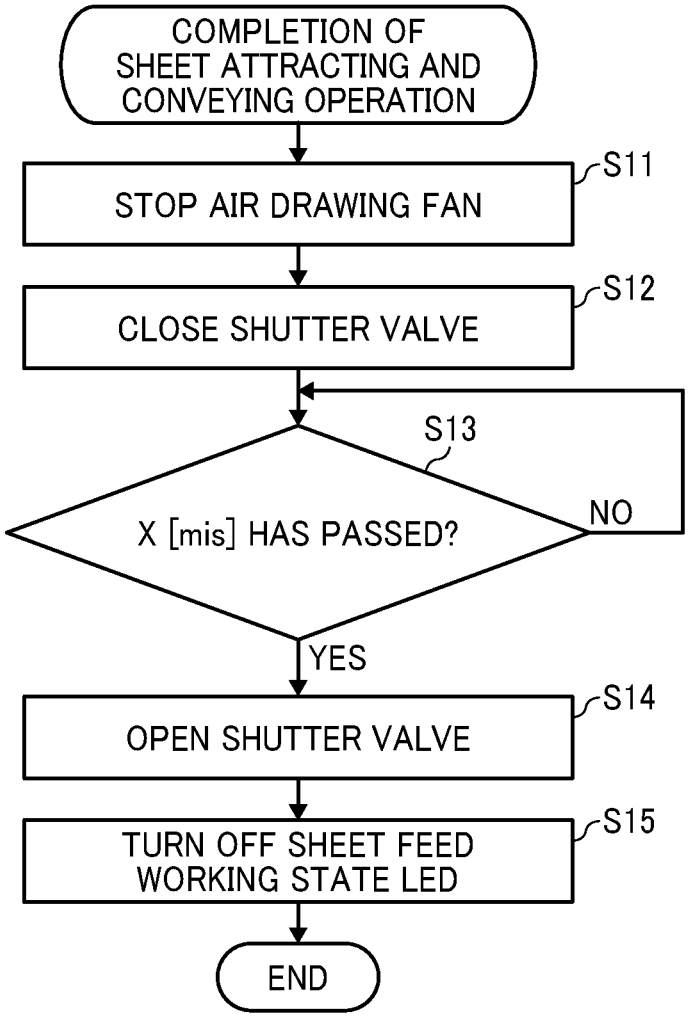
FIG. 10 is a flowchart of an example of operations after completion of sheet attracting and conveying operations.

FIG. 10 is a flowchart of an example of operations after completion of the sheet attracting and conveying operation.

When the sheet attracting and conveying operation performed by the sheet attracting and conveying device is completed, the controller 60 causes the air drawing fan 61 to stop (step S11), arid the shutter valve 42 to be closed (step S12). At this time, the leak hole that has been closed by the shutter valve 42 becomes open. When the sheet feeding device 200 according to the present embodiment is compared with a comparative sheet feeding device, the negative pressure of an attracting and conveying portion is not released in the comparative sheet feeding device. Therefore, it takes more time that a sheet separates from the attracting and conveying portion. By contrast, in the present embodiment, when attraction of a sheet by the air drawing is interrupted, the negative pressure in the sheet attracting unit 30 is released, and therefore the sheet can be separated from the sheet attraction belt 21 quickly. Then, the controller 60 determines whether or not the predetermined time has passed since the shutter valve 42 is closed (step S13). When S13 is NO and the predetermined time has not yet passed, the process repeats step S13. When step S13 is YES and the predetermined time has passed, the shutter valve 42 is open (step S14). As described above, by opening the shutter valve 42 after the predetermined time has elapsed, when a print job is requested and the air drawing fan 61 starts a sheet attracting operation, the step of opening the shutter valve 42 can be omitted.

Then, the controller 60 causes the shutter valve 42 to open and turns off the sheet feed working state LED 62 (step S15) simultaneously, and so as to indicate a user that the sheet tray 10 is ready to open.

As described above, by opening the shutter valve 42 when the sheet tray 10 is to be opened, that is, by turning off the solenoid 43, a user can be prevented from touching the heated solenoid 43, and therefore can be safe.

Next, a description is given of another example of configuration of the sheet feeding device 200.

Figure 11:
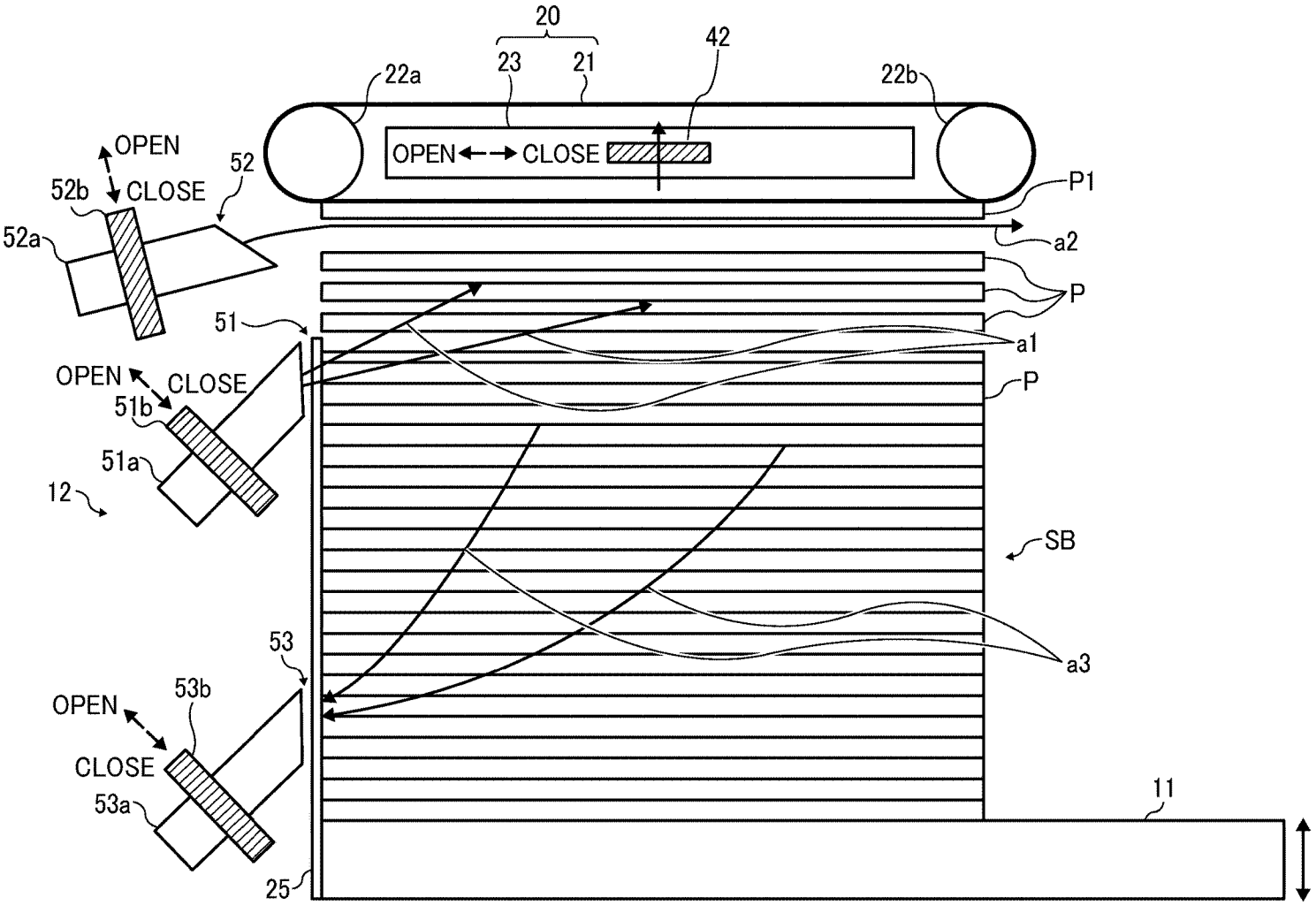
FIG. 11 is a diagram illustrating another example of the sheet feeding device according to an embodiment of this disclosure.
Figure 12A:
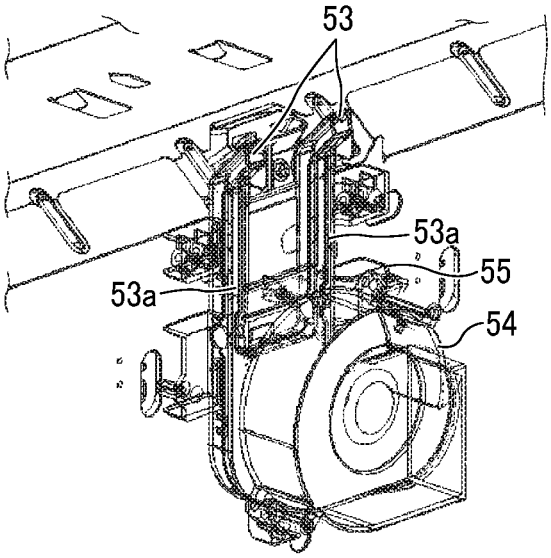
FIGS. 12A and 12B are diagrams illustrating a lower air drawing fan and a shutter mechanism.
Figure 12B:
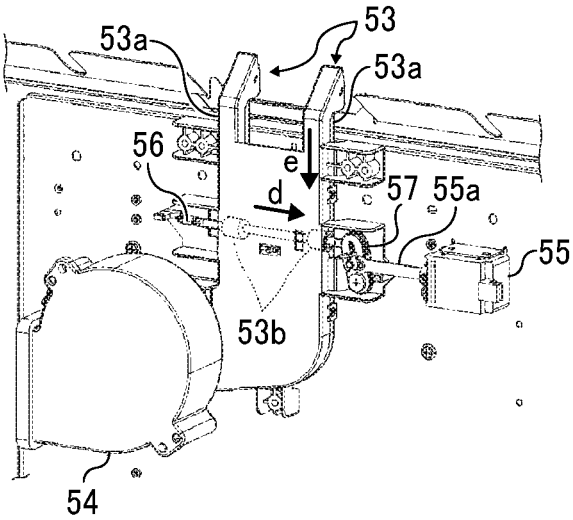

FIG. 11 is a diagram illustrating another example of the sheet feeding device 200 according to an embodiment of this disclosure. FIGS. 12A and 12B are diagrams illustrating a lower air drawing fan and a shutter mechanism.

As illustrated in FIG. 11, the sheet feeding unit 20 includes the sheet attraction belt 21 and the air drawing device 23, which is basically the same configuration as the above described embodiment. That is, the sheet attraction belt 21 is stretched by the two tension rollers 22*a* and 22*b* and the air drawing device 23 is disposed within the inner loop of the sheet attraction belt 21. The air drawing device 23 is coupled with the drawing fan that functions as an air drawing unit to intake air via the air duct that functions as an air flowing passage. As the air drawing device 23 generates a negative pressure in a lower area, the sheet P is attracted to a lower face of the sheet attraction belt 21.

The front air blowing device 12 includes a floating nozzle 51 and a separation nozzle 52. The floating nozzle 51 guides air to discharge in the direction to float a sheet P. The separation nozzle 52 guides air to discharge in a direction to separate an uppermost floating sheet and other floating sheet(s). Floating air is discharged from the floating nozzle 51 in the direction indicated by arrow a1 in FIG. 11 and separation air is discharged from the separation nozzle 52 in the direction indicated by arrow a2 in FIG. 11. Consequently, the floating air and the separation air are blown to the leading end of the upper sheets of the sheet bundle SB (i.e., the downstream side end in the sheet conveying direction). Accordingly, sheets P on the upper part of the sheet bundle SB are lifted and floated. As illustrated in FIG. 11, an air duct 51*a* is disposed between air blowing fans and is coupled to the floating nozzle 51 of the front air blowing device 12. Further, as illustrated in FIG. 11, an air duct 52*a* is disposed between air blowing fans and is coupled to the separation nozzle 52 of the front air blowing device 12. A shutter valve 51*b* that functions as an air blocking body is disposed in the air duct 51*a* to shut and open air inside the air duct 51*a*. Similarly, a shutter valve 52*b* that functions as a blocking body is disposed in the air duct 52*a* to shut and open air inside the air duct 52*a*.

Further, the front air blowing device 12 includes a lower air drawing nozzle 53 to draw air so as to direct an air drawing force toward a lower direction relative to the sheet in the vicinity of the uppermost sheet. As illustrated in FIGS. 12A and 12B, the lower air drawing nozzle 53 is coupled to a lower air drawing fan 54 that functions as a lower air drawing body to draw air via an air duct 53*a* that functions as a lower air drawing air duct. Consequently, the air in the vicinity of the uppermost sheet is drawn to the lower air drawing nozzle 53 in a direction indicated by arrow a3 in FIG. 11. A shutter valve 53*b* that functions as a lower suction air opening and closing device is disposed inside the air duct 53*a* of the air drawing device 23 to block and open air flow inside the air duct 53*a*.

Further, as illustrated in FIG. 12B, when a solenoid 55 is in a non-energized state in which an air drawing three of the solenoid 55 is not acting, that is, in an OFF state, the shutter valve 53*b* is pulled by a spring 56. Therefore, the shutter valve 53*b* shuts down air in the air duct 53*a*, which is in a closed state. When the solenoid 55 completely attracts a plunger 55*a*, that is, in an ON state, a lever 57 that is coupled to the plunger 55*a* is turned to move the shutter valve 53*b* toward a direction indicated by arrow d in FIG. 12B. By so doing, the closed state in which air flow in the air duct 53*a* is shut down is released, and therefore the suction air flows in a direction indicated by arrow e in FIG. 12B.

Figure 13:
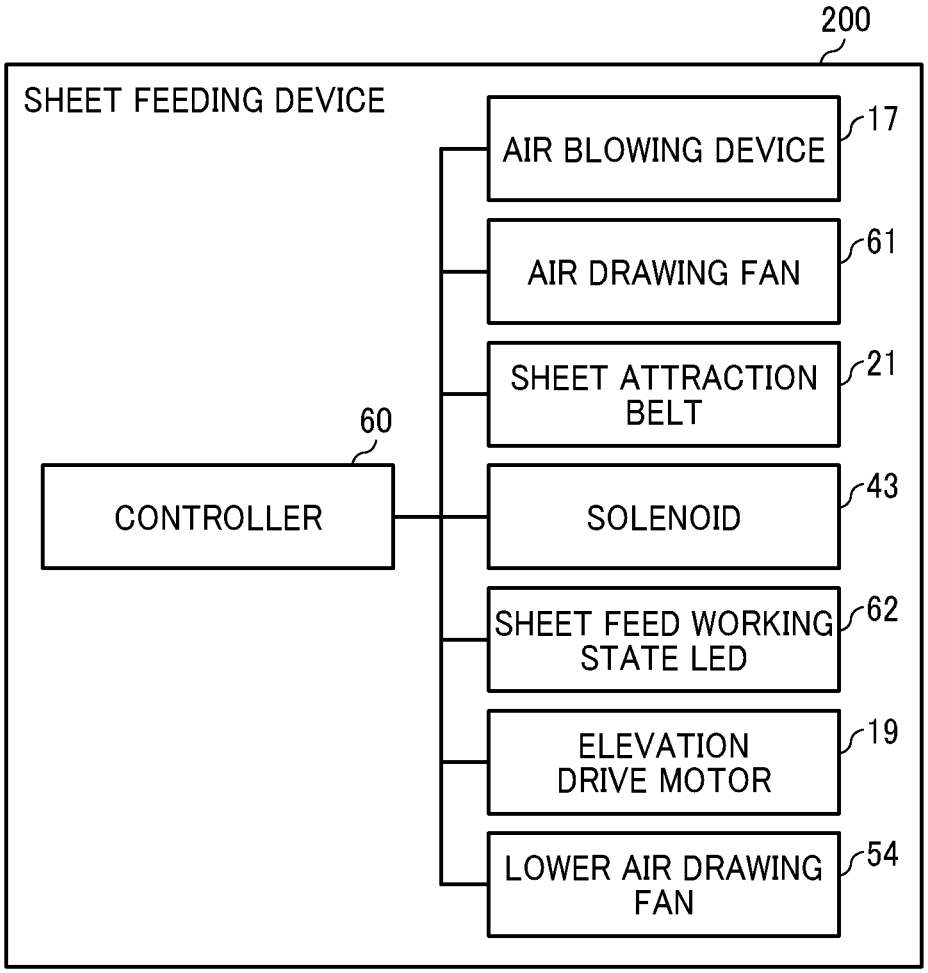
FIG. 13 is a block diagram illustrating another configuration of a control system included in the sheet feeding device according to an embodiment of this disclosure.

Next, FIG. 13 is a block diagram illustrating another configuration of a control system included in the sheet feeding device 200 according to an embodiment of this disclosure.

As illustrated in FIG. 13, the controller 60 that functions as a controller of the sheet feeding device 200 includes the air blowing device 17 to blow air toward the front air blowing device 12 and the side air blowing device 14, the air drawing fan 61 coupled with the air drawing device 23, the sheet attraction belt 21, and the solenoids 43 and 55 to causes the shutter valves 42 and 53*b* to start working, respectively. The controller 60 is further connected to the sheet feed working state LED 62 that functions as a working state indicator to indicate or display the working state of the sheet feeding device 200, the elevation drive motor 19 that functions as a loader elevation device to lift and lower the sheet loading table 11, and the lower air drawing fan 54 that functions as a lower air drawing body.

Next, a description is given of operations when the sheet feeding device 200 of FIG. 11 conveys sheets one by one.

Figure 14:
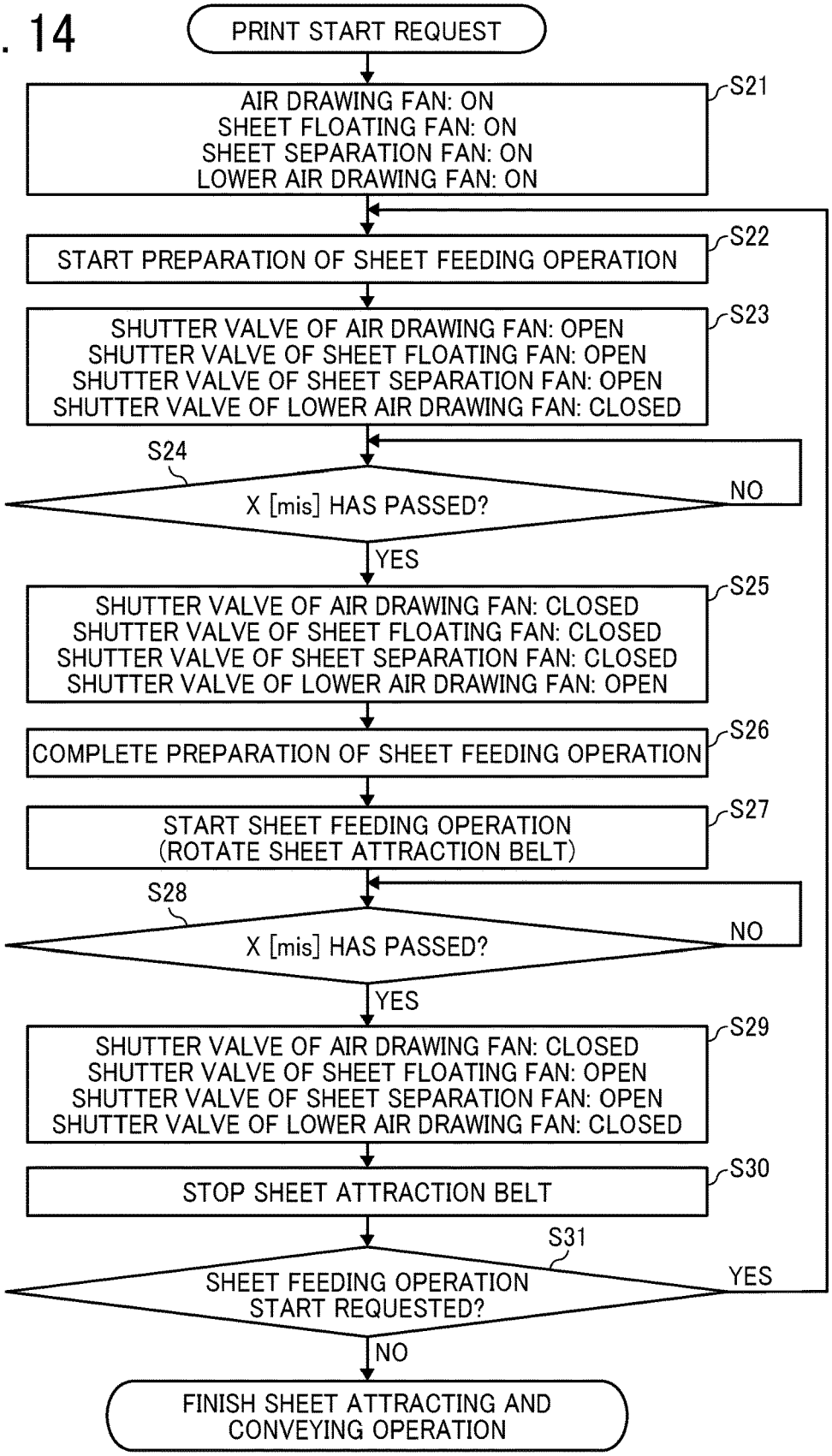
FIG. 14 is a flowchart of another sheet feeding operations of the sheet feeding device.

FIG. 14 is a flowchart of another sheet feeding operations of the sheet feeding device 200 of FIG. 11.

The general controller of the image forming apparatus 100 receives an image forming instruction associated with the sheets set in the sheet trays 10 of the sheet feeding device 200 of FIG. 13 via a control panel of the image forming apparatus 100. Then, the general controller transmits a sheet feeding instruction to the controller 60 of the sheet feeding device 200 and information of types of sheet loaded on the sheet loading table 11 of the sheet trays 10. On receipt of the sheet feeding instruction, the controller 60 starts driving the air blowing device 17 while movement of the sheet attraction belt 21 is being stopped. At the same time, the controller 60 starts driving the air drawing fan 61 to start air drawing by the air drawing device 23. As the air drawing device 23 starts air drawing, the air drawing device 23 generates a negative pressure in the lower area, and a floating uppermost sheet P1 is attracted to the sheet attraction belt 21. Further, at the same time, the controller 60 starts driving the lower air drawing fan 54 to start lower air drawing by the lower air drawing fan 54 (step S21).

It is to be noted that floating air generated in a floating fan is discharged from the floating nozzle 51 of the front air blowing device 12 and that separation air generated in a separation fan is discharged from the separation nozzle 52 of the front air blowing device 12.

With the above-described operations, the controller 60 prepares the sheet feeding operation (step S22).

At this time, the controller 60 causes the shutter valves 42, 51*b* and 52*b* to open and the shutter valve 53*b* to close (step S23). Accordingly, as illustrated in FIG. 11, air is discharged from the floating nozzle 51 of the front air blowing device 12 in the direction indicted by arrow a1. Therefore, the air is blown to the front end part of the upper part of the sheet bundle SB. Further, air is discharged from the air discharging port of the pair of side fences 13 (see FIG. 4) to be blown to the side end of the upper side of the sheet bundle SB. Due to the air discharged and blown through the air discharging ports of the front air blowing device 12 and through the air discharging ports of the pair of side fences 13, the upper sheet of the sheet bundle SB is lifted to float. Further, air is discharged from the separation nozzle 52 of the front air blowing device 12 in the direction indicted by arrow a2. Therefore, the air is blown to the floating uppermost sheet P and the other sheet(s) of the sheet bundle SB. Then, the controller 60 causes the air drawing device 23 to generate a negative pressure in the lower area.

Then, the controller 60 determines whether or not the predetermined time (X) has passed from the start of the sheet feeding operation (step S24). When S24 is NO and the predetermined time has not yet passed, the process repeats step S24. When step S24 is YES and the predetermined time has passed, the sheet P is attracted to the lower face of the sheet attraction belt 21. Consequently, the controller 60 causes the shutter valves 51*b* and 52*b* to close and the shutter valves 42 and 53*b* to open (step S25). With the above-described operations, the controller 60 completes the preparation of the sheet feeding operation (step S26).

Then, as the sheet attraction belt 21 rotates, the sheet feeding operation starts (step S27). Then, the controller 60 determines whether or not the predetermined time (X) has passed from the start of the sheet feeding operation (step S28). When step S28 is NO and the predetermined time has not yet passed, the process repeats step S28. When step S28 is YES and the predetermined time has passed, the shutter valves 51*b* and 52*b* are open and the shutter valves 42 and 53*b* are closed (step S29). As described above, by performing step S29 no matter there is a request of the start of the sheet conveying operation or not, the subsequent sheet is floated and separated, so that the sheet attracting and conveying operation can be performed whenever the start of the sheet feeding operation is requested. Accordingly, a high productivity can be obtained. Then, the controller 60 causes the sheet attraction belt 21 to stop (step S30).

Then, the controller 60 determines whether or not another instruction of the start of the sheet feeding operation is requested (step S31). When step S31 is YES and the start of the sheet feeding operation is requested, step S22 through step S30 are repeated to convey the subsequent sheet. When step S31 is NO and the start of the sheet feeding operation is not requested, the sheet attracting and conveying operation is finished, then the controller 60 executes another operation flow after the sheet attracting and conveying operation.

Next, a description is given of another operations after completion of the sheet attracting and conveying operation, according to the present embodiment of this disclosure.

Figure 15:
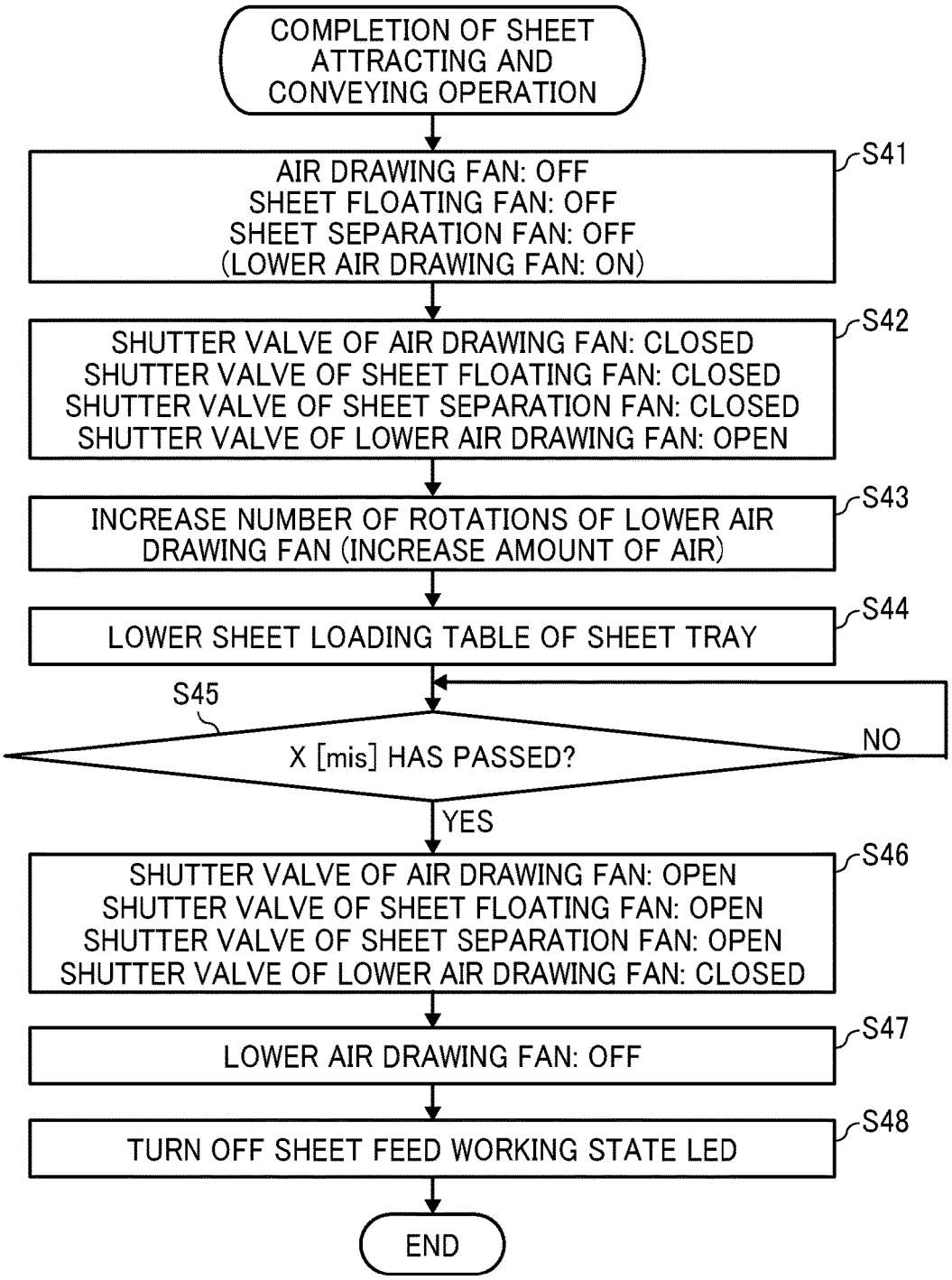
FIG. 15 is a flowchart of another example of operations after completion of sheet attracting and conveying operations.
Figure 16:
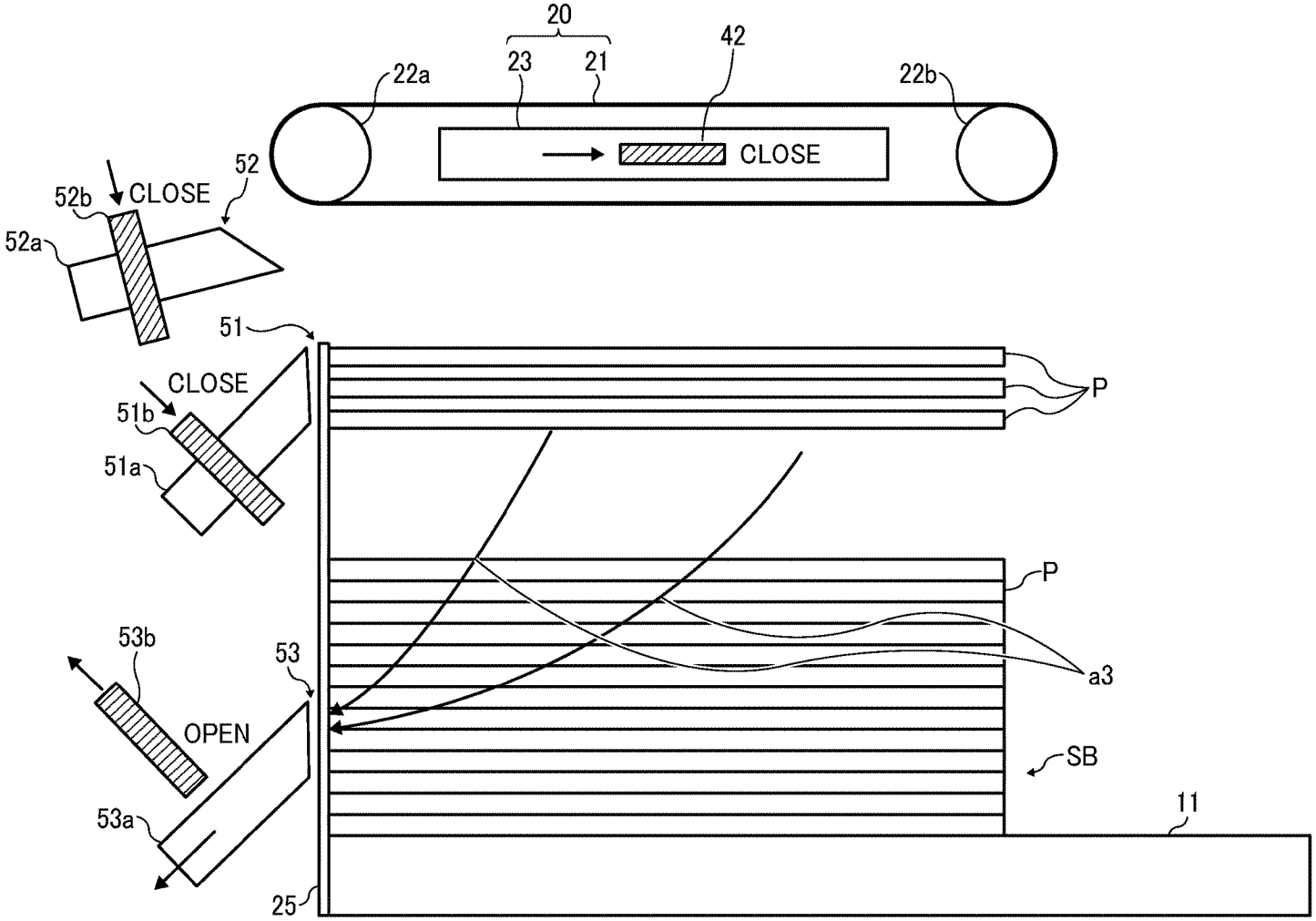
FIG. 16 is a diagram illustrating opening and closing of the shutter valve and movement of a sheet in the sheet feeding device.
Figure 17:
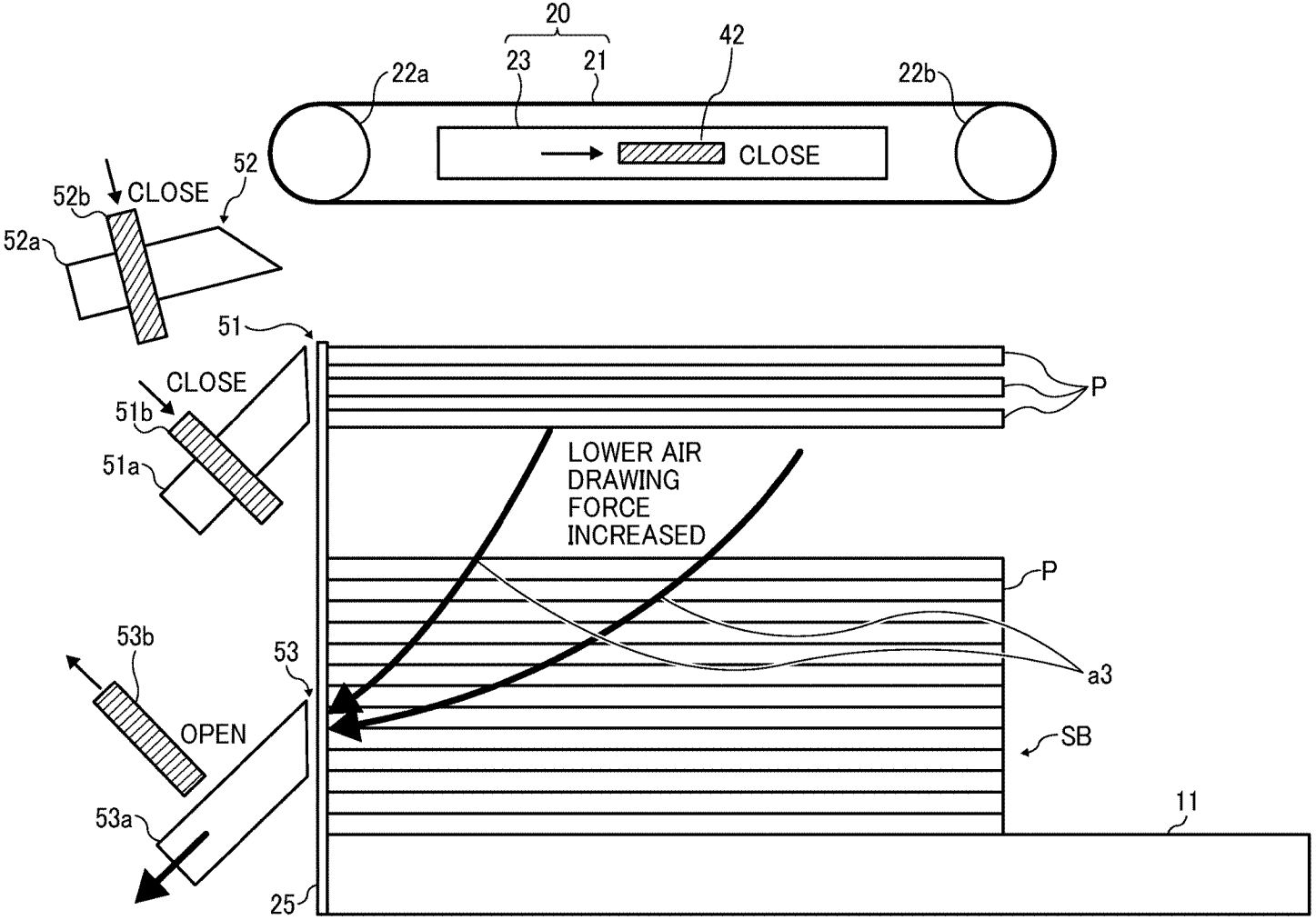
FIG. 17 is a diagram illustrating movement of the sheet when a lower air drawing force is increased.
Figure 18:
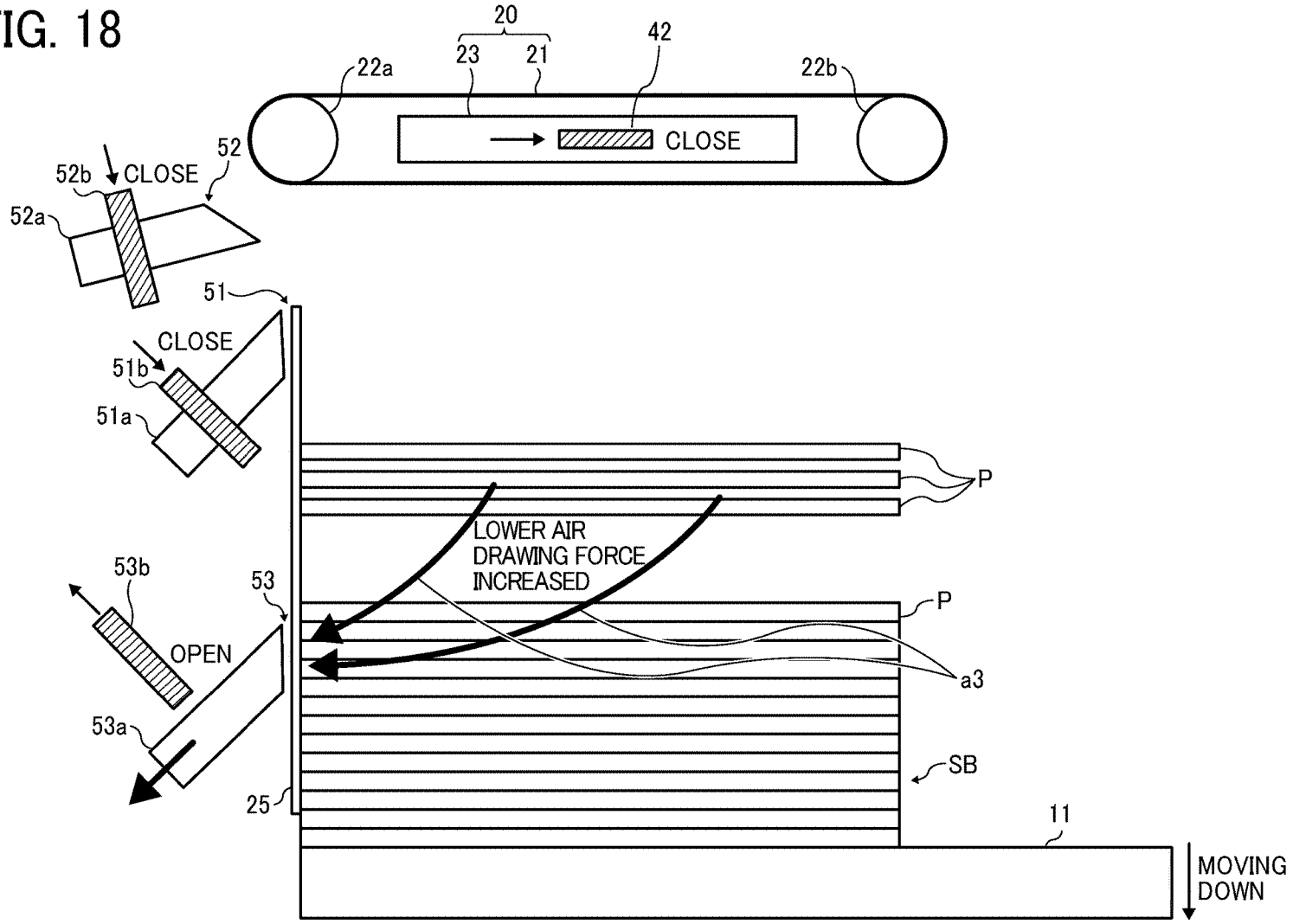
FIG. 18 is a diagram illustrating the movement of the sheet when a sheet loader is lowered.

FIG. 15 is a flowchart of another example of operations after completion of the sheet attracting and conveying operation. FIG. 16 is a diagram illustrating opening and closing of the shutter valve and movement of the sheet in the sheet feeding device 200. FIG. 17 is a diagram illustrating movement of the sheet when the lower air drawing force is increased. FIG. 18 is a diagram illustrating the movement of the sheet when the sheet loading table is lowered.

When the sheet attracting and conveying operation performed by the sheet attracting and conveying device is completed, the controller 60 of FIG. 13 transmits an instruction to stop the air drawing fan 61, the floating fan and the separation fan (step S41). The controller 60 causes the lower air drawing fan 54 to continue to drive. At this time, even when the instructions to stop rotation of the air drawing fan 61, the floating fan and the separation fan are transmitted, air corresponding to the amount of rotation attenuation of each fan are exhausted. Therefore, the operation is adversely affected by the air for a certain period of time. In order to address this inconvenience, as illustrated in FIG. 16, the controller 60 transmits the instructions to stop rotation of the air drawing fan 61, the floating fan and the separation fan and, at the same time, causes the shutter valves 42, 51*b* and 52*b*. By so doing, air exhaustion of the air by the amount of rotation attenuation of each fan is blocked. Further, by opening the shutter valve 53*b*, the sheet is encouraged to fall onto the sheet loading table of the sheet tray (step S42).

Further, as illustrated in FIG. 17, the number of rotations of the lower air drawing fan 54 is more increased than the number of rotations during the sheet feeding operation, so that the lower air drawing force is increased (step S43). Furthermore, as illustrated in FIG. 18, the controller 60 causes the sheet loading table to be lowered (step S44). By so doing, the sheet is separated away from the air corresponding to the amount of rotation attenuation of each of the air drawing fan 61, the floating fan and the separation fan, and therefore the adverse effect due to the air is prevented. Accordingly, the sheet is further encouraged to fall onto the sheet loading table of the sheet tray. In the present embodiment, when the attraction of a sheet by the air drawing is interrupted, the negative pressure in the sheet attracting unit 30 is released simultaneously. Therefore, the sheet can be separated from the sheet attraction belt 21 more quickly.

Then, the controller 60 determines whether or not the predetermined time has passed since the shutter valves 42, 51*b* and 52*b* are closed (step S45). When S45 is NO and the predetermined time has not yet passed, the process repeats step S45. When step S45 is YES and the predetermined time has passed, the controller 60 causes the shutter valve 42 to open (step S46). By so doing, when a print job is requested and the air drawing fan 61 starts the sheet attracting operation, the step of opening the shutter valves 42, 51*b* and 52*b* can be omitted. Then, the controller 60 causes the lower air drawing fan 54 to turn off (step S47) and turns off the sheet feed working state LED 62 (step S48) simultaneously, so as to indicate a user that the sheet tray 10 is ready to open.

As described above, by encouraging the sheet to fall on the sheet loading table by the lower air drawing when the attracting and conveying operation is completed, additional rise and additional attraction of the sheet can be prevented and, at the same time, a waiting time to be ready for pulling out the sheet loading table can be reduced without causing any damage to the sheet when the sheet loading table is pulled out.

This configurations according to the above-described embodiments are not limited thereto. This disclosure can achieve the following aspects effectively.

Aspect A.

In Aspect A, a sheet feeding device such as the sheet feeding device 200 includes a sheet loader such as the sheet loading table 11, an air drawing body such as the air drawing fan 61, and an attracting and conveying device such as the sheet attraction belt 21 and the air drawing device 23. The sheet loader is a device on which a bundle of sheets is loaded. The air drawing body is configured to generate suction air. The attracting and conveying device is configured to attract an uppermost sheet on the bundle of sheets by the air drawing body and convey the attracted sheet. The attracting and conveying device includes a sheet attracting portion such as the sheet attracting unit 30 configured to attract the uppermost sheet, an air duct such as the air duct 41 configured to intake the suction air to the sheet attracting portion, a blocking device such as the shutter valve 42 configured to block the suction air in the air duct, and a controller such as the controller 60 configured to control a shutdown operation of the suction air. The controller is configured to shut down the suction air at completion of conveyance of the uppermost sheet by the attracting and conveying device.

In Aspect A, the blocking device shuts down the suction air at completion of conveyance of the sheet. Therefore, at completion of conveyance of the sheet, the suction air can be blocked by the blocking device at the same time when the air drawing body is stopped. According to this configuration, when compared with a comparative sheet feeding device that does not include the blocking device, attraction of the sheet with the suction air during the stop of operation of the air drawing body can be shut down quickly. Therefore, the time that the sheet attracted to the attracting and conveying device is separated from the attracting and conveying device can be reduced. Accordingly, the waiting time to be ready for pulling out the sheet loader can be reduced without causing any damage to the sheet when the sheet loader is pulled out.

Aspect B.

The sheet feeding device according to Aspect A further includes a working state indicator such as the sheet feed working state LED 62 configured to indicate a working state of the sheet feeding device. At a time that a set time has passed since the suction air in the air duct such as the air duct 41 is shut down by the blocking device such as the shutter valve 42, the controller such as the controller 60 causes the working state indicator to indicate that the sheet feeding device is not under operation.

In Aspect B, as described in the above-described embodiment, a user can be prevented from touching a heated solenoid such as the solenoid 43, and therefore can be safe.

Aspect C.

The sheet feeding device according to Aspect A or Aspect B further includes a loader elevation device such as the elevation drive motor 19 configured to lift and lower the sheet loader, a plate configured to regulate a leading end position of the bundle of sheets in a sheet conveying direction, a floating air blower such as the front air blowing device 12 configured to blow air from the leading end position of the bundle of sheets and cause the sheet to float, and a separating air blower such as the front air blowing device 12 configured to blow air to the leading end of sheets floated by the floating air blower and cause the sheets to be separated one by one. The sheet attracting and conveying device such as the sheet attraction belt 21 and the air drawing device 23 is configured to attract an uppermost sheet of the sheets floated by the floating air blower and convey the uppermost sheet. The blocking device such as the shutter valve 42 uses a solenoid such as the solenoid 43 and a tension spring to shut down the suction air in the air duct such as the air duct 4L The controller such as the controller 60 causes the suction air to be shut down by the blocking device via the solenoid.

Aspect D.

In the sheet feeding device according to any one of Aspect A through Aspect C, the air duct includes a wall having a leak hole such as the leak hole 44 that goes through an inside and an outside of the air duct. When the suction air is blocked by the blocking device such as the shutter valve 42, the leak hole becomes open.

In Aspect D, as described in the above-described embodiments, the sheet can be peeled off or separated from the sheet attracting belt that functions as the attracting and conveying device more quickly. Accordingly, at completion of the sheet attracting and conveying operation, the sheet attracted to the sheet attracting and conveying device can be returned to the sheet loader quickly.

Aspect E.

In the sheet feeding device according to Aspect D, when the suction air is not blocked by the blocking device such as the shutter valve 42, the leak hole such as the leak hole 44 is closed by the blocking device. By contrast, when the suction air is blocked by the blocking device, the leak hole is opened by the blocking device.

In Aspect E, by switching the dosing and opening of the leak hole by the blocking device, no mechanism dedicated to the closing and opening of the leak hole needs to be provided.

Aspect F.

The sheet feeding device according to Aspect A further includes a lower air drawing body configured to attract the sheet by a lower suction air directing to the sheet loader, a lower air drawing air duct such as the air duct 53*a* through which the lower suction air drawn by the lower air drawing body passes, and a lower suction air opening and closing device such as the shutter valve 53*b* configured to block and open the lower suction air in the lower air drawing air duct. The controller such as the controller 60 is configured to release the lower suction air in the lower air drawing air duct by the lower suction air opening and closing device, at completion of conveyance of the uppermost sheet by the attracting and conveying device.

In Aspect F, as described in the above-described embodiments, the sheet can be peeled off or separated from the sheet attracting belt more quickly. Accordingly, at completion of the sheet attracting and conveying operation, the sheet attracted to the sheet attracting and conveying device can be returned to the sheet loader quickly.

Aspect G.

In the sheet feeding device according to Aspect F, the controller increases an air drawing force applied by the lower air drawing body at completion of conveyance of the sheet by the attracting and conveying device.

In Aspect G, as described in the above-described embodiments, the sheet can be encouraged to fall onto the sheet loader.

Aspect H.

In the sheet feeding device according to Aspect F or Aspect G, the controller causes the sheet loader to be lowered at completion of conveyance of the sheet by the attracting and conveying device.

In Aspect H, as described in the above-described embodiments, the sheet loader is lowered to separate the sheet away from the suction air. Therefore, a negative impact by the air can be prevented. Therefore, the sheet can be encouraged to fall onto the sheet loader.

Aspect I.

In Aspect I, an image forming apparatus includes an image forming device to form an image on a surface of a sheet, and the sheet feeding device according to any one of Aspect A through Aspect H to feed the sheet to the image forming device.

In Aspect I, the image forming apparatus, in which the waiting time to be ready for pulling out the sheet loader can be reduced without causing any damage to the sheet when the sheet loader is pulled out, can be provided.

Aspect J.

In Aspect J, an image forming system includes at least an image forming apparatus including an image forming device to form an image on a surface, and the sheet feeding device according to any one of sheet feeding device according to any one of Aspect A through Aspect G to feed the sheet to the image forming device.

In Aspect J, the image forming system, in which the waiting time to be ready for pulling out the sheet loader can be reduced without causing any damage to the sheet when the sheet loader is pulled out, can be provided.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeding device comprising:

a sheet loader, configured to receive a bundle of sheets;

an air drawing body configured to generate suction air;

an attracting and conveying device configured to attract a sheet, the sheet being an uppermost sheet of the bundle of sheets, by the suction air and configured to convey the sheet;

an air duct configured to intake the suction air generated by the air drawing body, to the attracting and conveying device; and a blocking device configured to block the suction air in the air duct, wherein the blocking device includes a shutter valve disposed in the air duct; and a solenoid configured to switch the shutter valve between an open state, wherein the shutter valve is configured to open a passage of the air duct and a closed state, wherein the shutter valve is configured to close the passage of the air duct, wherein the air duct includes a wall including a leak hole passing through an inside of the air duct and an outside of the air duct, wherein the shutter valve includes a shielding body configured to shield the leak hole when the shutter valve is in the open state, and wherein, when the shutter valve is in the closed state, the shielding body is configured to be located at a position to open the leak hole.

2. The sheet feeding device of claim 1, further comprising:

a loader elevation device configured to lift and lower the sheet loader;

a plate configured to regulate a leading end position of the bundle of sheets in the sheet conveying direction;

a floating air blower configured to blow air from the leading end position of the bundle of sheets and configured to cause a plurality of sheets, of the bundle of sheets, to float; and a separating air blower configured to blow air to the leading end of the plurality of sheets floated by the floating air blower and configured to cause the plurality of sheets floated to be separated one by one.

3. The sheet feeding device of claim 1, wherein the air duct includes a wall including a leak hole passing through an inside of the air duct and an outside of the air duct, and wherein, when the suction air is blocked by the blocking device, the leak hole becomes open.

4. The sheet feeding device of claim 1, further comprising a controller configured to control the sheet feeding device, wherein the controller is configured to block the suction air by the blocking device upon completion of conveyance of the sheet by the attracting and conveying device.

5. The sheet feeding device of claim 4, further comprising an indicator configured to indicate a working state of the sheet feeding device, wherein the indicator is configured to turn on and off light, and wherein, at a set time passed since the suction air in the air duct is shut down by the blocking device, the controller is configured to turn off the indicator.

6. An image forming apparatus comprising:

an image forming device configured to form an image on a sheet; and the sheet feeding device of claim 1, configured to feed the sheet toward the image forming device.

7. An image forming system comprising:

an image forming apparatus including an image forming device configured to form an image on a sheet; and the sheet feeding device of claim 1, configured to feed the sheet toward the image forming device.

8. A sheet feeding device comprising:

a sheet loader, configured to receive a bundle of sheets;

an air drawing body configured to generate suction air;

an attracting and conveying device configured to attract a sheet, the sheet being an uppermost sheet of the bundle of sheets, by the suction air and configured to convey the sheet;

an air duct configured to intake the suction air generated by the air drawing body, to the attracting and conveying device; and a blocking device configured to block the suction air in the air duct, wherein the air duct includes a wall including a leak hole passing through an inside of the air duct and an outside of the air duct, wherein, when the suction air is blocked by the blocking device, the leak hole becomes open, and, wherein, when the suction air is not blocked by the blocking device, the leak hole is closed by the blocking device.

9. The sheet feeding device of claim 8, further comprising:

a lower air drawing body configured to attract the sheet by a lower suction air directing to the sheet loader;

a lower air drawing air duct configured to pass the lower suction air drawn by the lower air drawing body; and a lower suction air opening and closing device configured to block the lower suction air in the lower air drawing air duct and configured to pass the lower suction air in the lower air drawing air duct.

10. The sheet feeding device of claim 8, further comprising a controller configured to control the sheet feeding device, wherein the controller is configured to block the suction air by the blocking device upon completion of conveyance of the sheet by the attracting and conveying device.

11. The sheet feeding device of claim 10, further comprising an indicator configured to indicate a working state of the sheet feeding device, wherein the indicator is configured to turn on and off light, and wherein, at a set time passed since the suction air in the air duct is shut down by the blocking device, the controller is configured to turn off the indicator.

12. A sheet feeding device comprising:

a sheet loader, configured to receive a bundle of sheets;

an air drawing body configured to generate suction air;

an attracting and conveying device configured to attract a sheet, the sheet being an uppermost sheet of the bundle of sheets, by the suction air and configured to convey the sheet;

an air duct configured to intake the suction air generated by the air drawing body, to the attracting and conveying device;

a blocking device configured to block the suction air in the air duct;

a lower air drawing body configured to attract the sheet by a lower suction air directing to the sheet loader;

a lower air drawing air duct configured to pass the lower suction air drawn by the lower air drawing body; and a lower suction air opening and closing device configured to block the lower suction air in the lower air drawing air duct and configured to pass the lower suction air in the lower air drawing air duct.

13. The sheet feeding device of claim 12, further comprising a controller configured to control the sheet feeding device, wherein the controller is configured to cause the lower suction air opening and closing device to release the lower suction air in the lower air drawing air duct upon completion of conveyance of the sheet by the attracting and conveying device.

14. The sheet feeding device of claim 13, wherein the controller increases an air drawing force applied by the lower air drawing body upon completion of conveyance of the sheet by the attracting and conveying device.

15. The sheet feeding device of claim 13, wherein the controller is configured to cause the sheet loader to be relatively lowered upon completion of conveyance of the sheet by the attracting and conveying device.

16. An image forming apparatus comprising:

an image forming device configured to form an image on a sheet; and the sheet feeding device of claim 12, configured to feed the sheet toward the image forming device.

17. An image forming system comprising:

an image forming apparatus including an image forming device configured to form an image on a sheet; and the sheet feeding device of claim 12, configured to feed the sheet toward the image forming device.

18. A sheet feeding device comprising:

a sheet loader, configured to receive a bundle of sheets;

an air drawing body configured to generate suction air;

an attracting and conveying device configured to attract a sheet, the sheet being an uppermost sheet of the bundle of sheets, by the suction air and configured to convey the sheet;

an air duct configured to intake the suction air generated by the air drawing body, to the attracting and conveying device;

a blocking device configured to block the suction air in the air duct;

a controller configured to control the sheet feeding device, the controller being configured to block the suction air by the blocking device upon completion of conveyance of the sheet by the attracting and conveying device; and an indicator configured to indicate a working state of the sheet feeding device, wherein the indicator is configured to turn on and off light, and wherein, at a set time passed since the suction air in the air duct is shut down by the blocking device, the controller is configured to turn off the indicator.

19. An image forming apparatus comprising:

an image forming device configured to form an image on a sheet; and the sheet feeding device of claim 18, configured to feed the sheet toward the image forming device.

20. An image forming system comprising:

an image forming apparatus including an image forming device configured to form an image on a sheet; and the sheet feeding device of claim 18, configured to feed the sheet toward the image forming device.

* * * * *